US010650649B2

(12) United States Patent
Mysell

(10) Patent No.: US 10,650,649 B2
(45) Date of Patent: May 12, 2020

(54) MONITORING DEVICE

(71) Applicant: ATF Services Pty Ltd, Seven Hills, NSW (AU)

(72) Inventor: Robin Marcus Mysell, New South Wales (AU)

(73) Assignee: ATF Services Pty Ltd., New South Wales (AU)

( * ) Notice: Subject to any disclaimer, the term of this patent is extended or adjusted under 35 U.S.C. 154(b) by 0 days.

(21) Appl. No.: 16/331,093

(22) PCT Filed: Sep. 8, 2017

(86) PCT No.: PCT/AU2017/050987
§ 371 (c)(1),
(2) Date: Mar. 6, 2019

(87) PCT Pub. No.: WO2018/045434
PCT Pub. Date: Mar. 15, 2018

(65) Prior Publication Data

US 2019/0206207 A1 Jul. 4, 2019

(30) Foreign Application Priority Data

Sep. 9, 2016 (AU) ..... 2016903638

(51) Int. Cl.

| | |
|---|---|
| ***G08B 13/19*** | (2006.01) |
| ***G08B 25/00*** | (2006.01) |
| ***G08B 29/04*** | (2006.01) |
| ***G08B 13/193*** | (2006.01) |
| ***G08C 17/02*** | (2006.01) |
| ***H04R 1/08*** | (2006.01) |
| ***H04R 3/00*** | (2006.01) |

(52) U.S. Cl.
CPC ..... *G08B 13/19* (2013.01); *G08B 13/193* (2013.01); *G08B 25/009* (2013.01); *G08B 29/046* (2013.01); *G08C 17/02* (2013.01); *H04R 1/08* (2013.01); *H04R 3/00* (2013.01)

(58) Field of Classification Search
CPC .... G08B 13/19; G08B 13/193; G08B 25/009; G08B 29/046; G08C 17/02; H04R 1/08; H04R 3/00
USPC ..... 340/567
See application file for complete search history.

(56) References Cited

U.S. PATENT DOCUMENTS 7,884,727 B2 * 2/2011 Tran ..... A61B 5/0006 340/573.1
8,779,921 B1 * 7/2014 Curtiss ..... G08B 25/009 340/506

(Continued)

OTHER PUBLICATIONS

International Search Report and Written Opinion for PCT/AU2017/050987, dated Nov. 22, 2017, 8 pages.

*Primary Examiner* — Hirdepal Singh
(74) *Attorney, Agent, or Firm* — Blank Rome LLP

(57) ABSTRACT

Disclosed herein are a monitoring device and systems utilising one or more such monitoring devices. The monitoring device comprises a protective housing containing: a passive infrared (PIR) sensor; a power supply a microcontroller; and a wireless transceiver. The power supply powers each of said PIR sensor, said microcontroller, and said wireless transceiver. The microcontroller is adapted to send an alert message, via said wireless transceiver, upon receiving a motion detection signal from said PIR sensor.

12 Claims, 25 Drawing Sheets

(56) References Cited

U.S. PATENT DOCUMENTS

| | | | | |
|---|---|---|---|---|
| 9,684,834 | B1 * | 6/2017 | Ludwig | G06K 9/00677 |
| 10,127,782 | B1 * | 11/2018 | Barth | G08B 13/08 |
| 2012/0032834 | A1 * | 2/2012 | Weeks | G01S 7/003 342/118 |
| 2012/0155602 | A1 * | 6/2012 | O'Shea | G01S 11/12 377/16 |
| 2014/0313032 | A1 * | 10/2014 | Sager | H04Q 9/00 340/539.17 |
| 2015/0097958 | A1 * | 4/2015 | Fadell | G05B 15/02 348/152 |
| 2018/0291650 | A1 * | 10/2018 | Zabala Zabaleta | G07C 9/00896 |
| 2019/0132558 | A1 * | 5/2019 | Lu | H04N 5/91 |

* cited by examiner

MONITORING DEVICE

RELATED APPLICATIONS

The present application is a national phase of PCT/AU2017/050987, filed on Sep. 8, 2017, which claims priority to Australian Provisional Patent Application No. 2016903638 titled "Monitoring device" and filed 9 Sep. 2016 in the name of ATF Services Pty Ltd, and Australian Innovation Patent No. 2017100209 titled "Monitoring device" and filed 9 Sep. 2016 in the name of ATF Services Pty Ltd, the entire content of each of which is incorporated by reference as if fully set forth herein.

TECHNICAL FIELD

The present disclosure relates to a monitoring device. In particular, the present disclosure relates to a monitoring device adapted for use in either indoor or outdoor environments.

BACKGROUND

Passive infrared sensors (PIRs) are electronic sensors that measure infrared (IR) light radiating from any objects within a field of view of the PIR sensor. All objects emit heat energy in the form of radiation. This emitted radiation is in the infrared region, with longer wavelengths than those of visible light, typically in the region of 700 nm to 1 mm.

PIR sensors are passive in that such sensors do not radiate any energy for the purpose of detection. Rather, PIR sensors detect energy radiated from other objects.

Existing PIR sensors may be utilised in monitoring devices, such as motion detectors, and are sometimes referred to as passive infrared detectors (PIDs). Such motion detectors are commonly used for burglar alarms and automatically-activated lighting systems. As such, these motion detectors are adapted for use in indoor environments or under protected eaves, where simple housings are adequate. Further, such applications have well-defined fields of view, as the motion detectors can be positioned to cover a known entrance or exit.

Existing PIR motion sensors are not suitable for outdoor environments with little or no protection from the weather. Accordingly, water ingress may cause intermittent faults, damage to circuitry, and even complete failure of such devices. Further, existing PIR devices are susceptible to malicious damage or tampering.

Thus, a need exists to provide an improved monitoring device.

SUMMARY

The present disclosure relates to a monitoring device.

A first aspect of the present disclosure provides a monitoring device comprising:

a protective housing containing:

a passive infrared (PI R) sensor;

a power supply a microcontroller; and a wireless transceiver;

wherein said power supply powers each of said PIR sensor, said microcontroller, and said wireless transceiver; and further wherein said microcontroller is adapted to send an alert message, via said wireless transceiver, upon receiving a motion detection signal from said PIR sensor.

A second aspect of the present disclosure provides a system comprising:

a set of monitoring devices, each monitoring device including:

a protective housing containing:

a passive infrared (PI R) sensor;

a power supply a microcontroller; and a wireless transceiver;

wherein said power supply powers each of said PIR sensor, said microcontroller, and said wireless transceiver; and further wherein said microcontroller is adapted to send an alert message, via said wireless transceiver, upon receiving a motion detection signal from said PI R sensor;

an administrative server coupled to a communications network; and a wireless base station for receiving said alert message, said wireless base station being coupled to a communications network and adapted to transmit said received alert message to said administrative server.

According to another aspect, the present disclosure provides an apparatus for implementing any one of the aforementioned methods.

According to another aspect, the present disclosure provides a computer program product including a computer readable medium having recorded thereon a computer program for implementing any one of the methods described above.

Other aspects of the present disclosure are also provided.

BRIEF DESCRIPTION OF THE DRAWINGS

One or more embodiments of the present disclosure will now be described by way of specific example(s) with reference to the accompanying drawings, in which.

DETAILED DESCRIPTION

Figure 1:
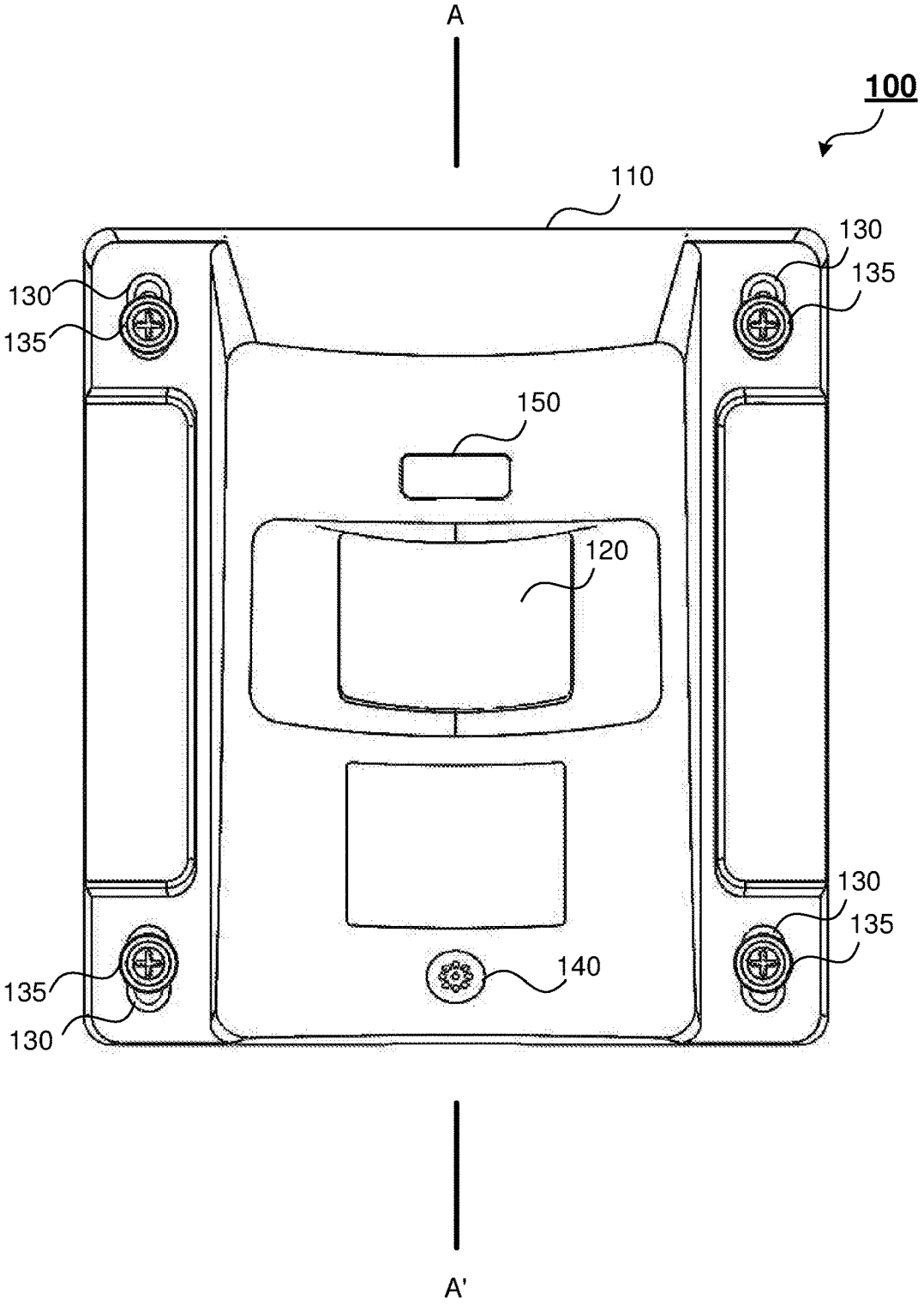
FIG. 1 is a front view of a monitoring device.

Method steps or features in the accompanying drawings that have the same reference numerals are to be considered to have the same function(s) or operation(s), unless the contrary intention is expressed or implied.

The present disclosure provides a monitoring device that is adapted for indoor and outdoor applications. The monitoring device includes a passive infrared (PIR) sensor module operating in combination with a Fresnel lens to define a field of view of the monitoring device. In one arrangement, a Fresnel lens (extra wide angle array) is utilised, rendering an effective field of view of 140° with a range of 1 to 15 metres. It will be appreciated that different effective fields of view may be obtained by using different Fresnel lens and different orientations of the monitoring device when placed ready for use.

In one or more embodiments, the monitoring device also includes a protective housing with one or more seals to prevent or reduce the ingress of moisture and water. Such seals may include, for example, but are not limited to, one or more grommets, O-rings, gaskets, or the like. In one arrangement, the monitoring device has an ingress protection rating (IPR) of 63 to 65, indicating that the monitoring device is dust tight and adapted to withstand ingress from spraying water, splashing water, or water jets. The protective housing is preferably shaped to encourage the run-off of water, such that no moisture collects on any portion of the protective housing.

The protective housing is made from a resilient material, to withstand inclement weather conditions and malicious attacks, as well as incidental knocks that may occur in a worksite environment. Suitable materials may include, for example, aluminium, plastic, and the like.

In one or more embodiments, the protective housing is adapted to be secured in place to a fixture. In one arrangement, the protective housing includes a plurality of apertures through which corresponding fasteners, such as screws or bolts, may be inserted to secure the housing to a fixture, such as a wall, post, eave, awning, or the like. In another arrangement, the protective housing includes one or more substantially flat regions to which an adhesive may be applied to adhesively secure the protective housing to a fixture. The adhesive may be, for example, double-sided adhesive tape. In alternative embodiments, the protective housing may be adapted to be placed on a flat surface.

In one arrangement, one or more packing pieces may be placed between the protective housing and the fixture, or between a lower surface of the protective housing and a surface on which the monitoring device is placed, in order to obtain a desired field of view and range for a particular location and/or to account for surfaces that are not perpendicular and/or parallel to a desired field of view.

The monitoring device includes a power supply, which may be implemented in the form of one or more batteries, a connection to a mains power supply or external DC power source, or a combination thereof. In one arrangement, the power supply includes 4 AA batteries. In one particular implementation, 4 AA batteries provide an operating life of approximately 12 months' operation. The monitoring device also includes a wireless transceiver for communicating with a remote server.

In one arrangement, the wireless transceiver is implemented using any suitable wireless transmission protocol, including, but not limited to, 3G, 4G, Wi-Fi, Bluetooth, LTE, or Low-Power Wide-Area Network (LPWAN) technologies, such as LTE-MTC, LoRa, NarrowBand IoT, 6LowPAN, or Sigfox. In one arrangement, the wireless transmission protocol corresponds to one or more IEEE technical standards, including, for example, IEEE 802 standards. In particular, the wireless transmission protocol may correspond to one of the IEEE 802.11 standards for wireless local area networks (WLANs) or the IEEE802.15.4 standard for low-rate wireless personal area networks (LR-WPANs).

The wireless transceiver is coupled to an antenna, which can be located either internally within the protective housing or externally of the protective housing. One arrangement utilises an external antenna coupled to a tamper switch, whereby the tamper switch triggers an alarm if the antenna is disconnected. Such an alarm may be a visual alarm, such as a flashing light, an audible alarm, such as a siren, an electronic message, or any combination thereof.

In some arrangements, the wireless transceiver of the monitoring device communicates with the remote server via an intermediary radio frequency (RF) gateway. Such an RF gateway is suitably adapted to receive wireless communications from the monitoring device and forward those communications to the remote server via a communications link, which may be implemented using a wired or wireless communication path, or any combination thereof, including a dedicated transmission line and/or the Internet. In one particular arrangement, the RF gateway is implemented using a Texas Instruments (TI) wireless microcontroller, such as a CC13x0 wireless microcontroller unit that supports the TI 15.4-Stack software for providing an IEEE 801.15.4e/g-based star topology networking solution in the sub 1 GHz transmission band.

In one arrangement, the monitoring device sends a health check message at predefined intervals, such as every 30 minutes, to the remote server, via the wireless transceiver. If the remote server does not receive a health check message for a time interval greater than said predefined interval, the remote server triggers an alarm. In this instance, such an alarm may be an alert message sent to an operator, such as may be displayed on a control panel or dashboard of a graphical user interface of an application executing on said remote server or on a website associated with said remote server. Alternatively, the alarm may be an electronic message, such as an email, short message service (SMS) text message, multimedia message service (MMS), chat message, message on a software application ("app") executing on a computing device, or the like. Such electronic messages may be referred to as push notifications from the remote server. Depending on the implementation, the electronic message may include a timestamp indicating the time at which the alarm was raised. The electronic message may also include an identifier corresponding to a serial number of the monitoring device associated with the alarm, a user or location associated with the monitoring device, or any combination thereof. The computing device may be, for example, but is not limited to, a server, personal computer, laptop computer, smartphone, tablet computing device, phablet computing device, and the like.

In one arrangement, a user is able to configure the remote server to send alert messages after a predefined number of missed health check messages. In the default scenario described above, an alert is sent as soon as one health check message is missed. In other scenarios, the user may configure the remote server to issue an alert after two or three health check messages have been missed, for example. Such a configuration prevents alerts from being raised unnecessarily in the event of transmission failures resulting from poor weather conditions or the like.

Similarly, the monitoring device is configured to transmit an alarm notification to the remote server upon the monitoring device having one or more triggers activated. In one arrangement, the monitoring device includes a set of triggers relating to a PIR sensor module, a light sensor, a microphone, an accelerometer, or any combination thereof. Upon a trigger being activated, the monitoring device sends the alarm notification to the remote server, whereupon the remote server issues an alarm. In this instance, such an alarm may be an alert message sent to an operator, such as may be displayed on a control panel or dashboard of a graphical user interface of an application executing on said remote server or on a website associated with said remote server. Alternatively, the alarm may be an electronic message, such as an email, short message service (SMS) text message, multimedia message service (MMS), chat message, message on a software application ("app") executing on a computing device, or the like.

FIG. 1 is a front view of a monitoring device 100 having a protective housing 110, a Fresnel lens 120, and a plurality of fixing apertures 130 for receiving a corresponding plurality of screws 135 for securing the housing 110 to a fixture. The monitoring device 100 also includes an optional microphone 140 for detecting noises and an optional light 150. The light 150 may be implemented using one or more light emitting diodes (LEDs) and may be used to provide an indication of an operating status of the monitoring device 100. The light 150 may also be used to issue an alarm, such as by flashing. Further, the light 150 may incorporate a light sensor for detecting changes in ambient light levels in the environment surrounding the monitoring device 100.

Figure 2:
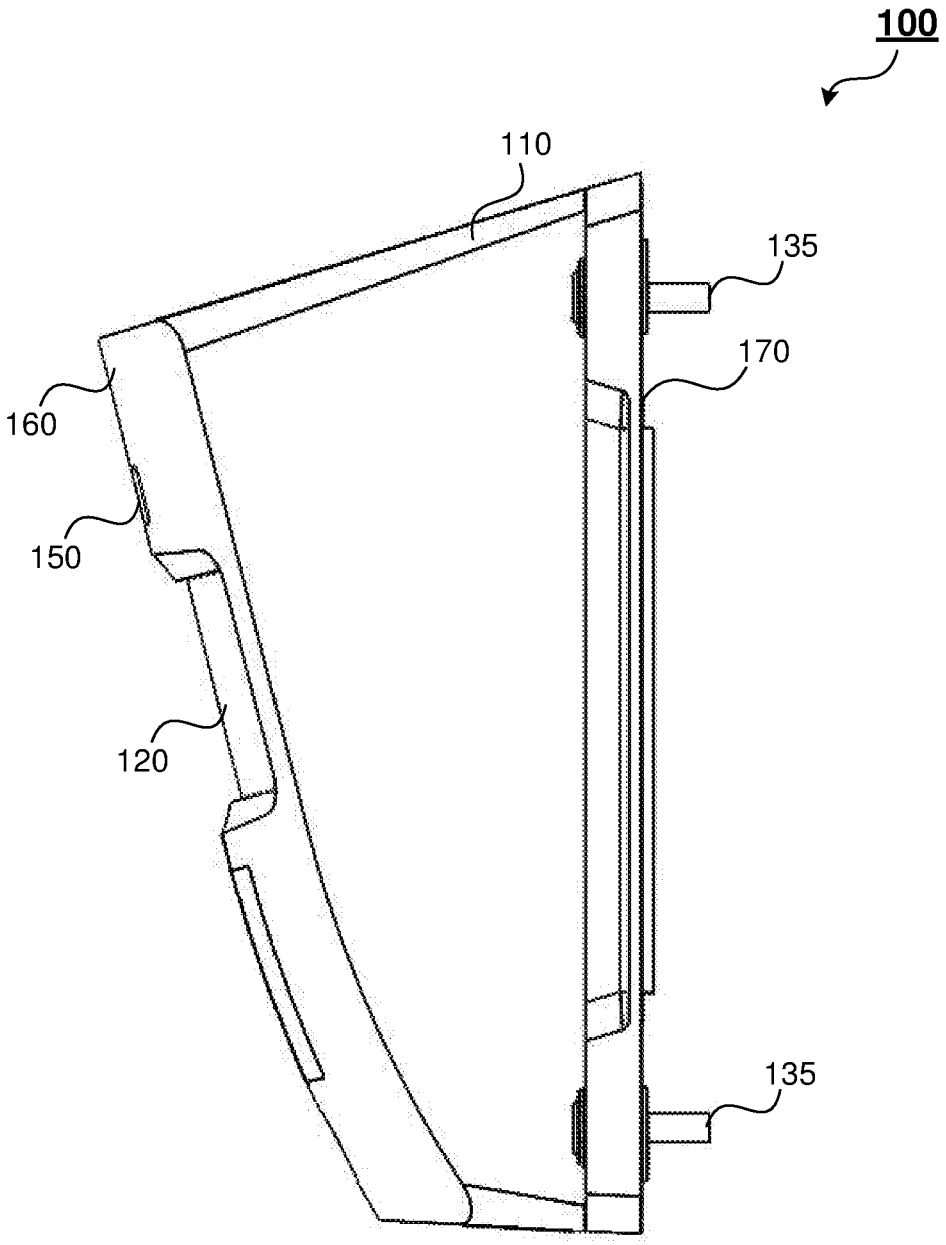
FIG. 2 is a left hand view of the monitoring device of FIG. 1.
Figure 3:
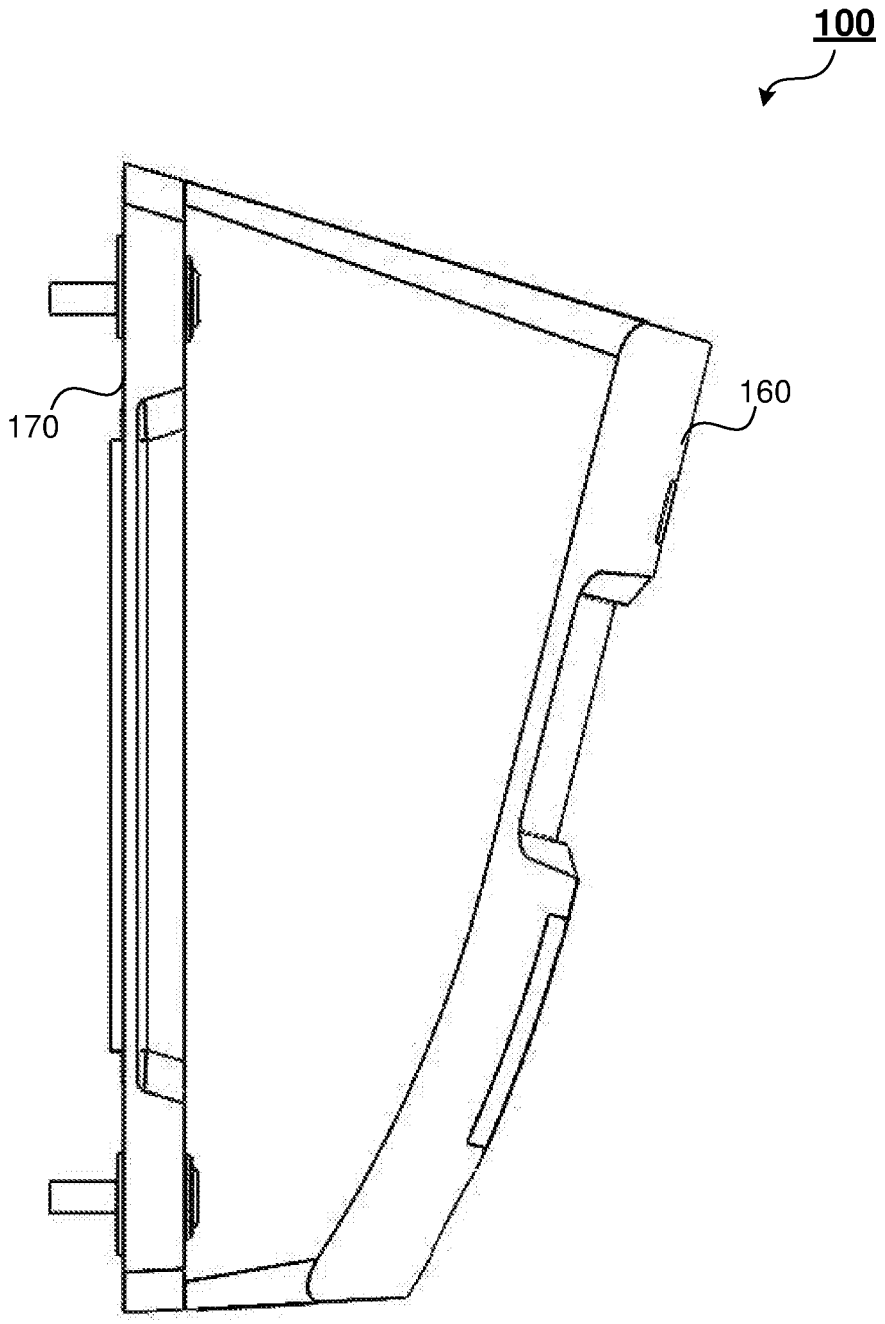
FIG. 3 is a right hand view of the monitoring device of FIG. 1.
Figure 4:
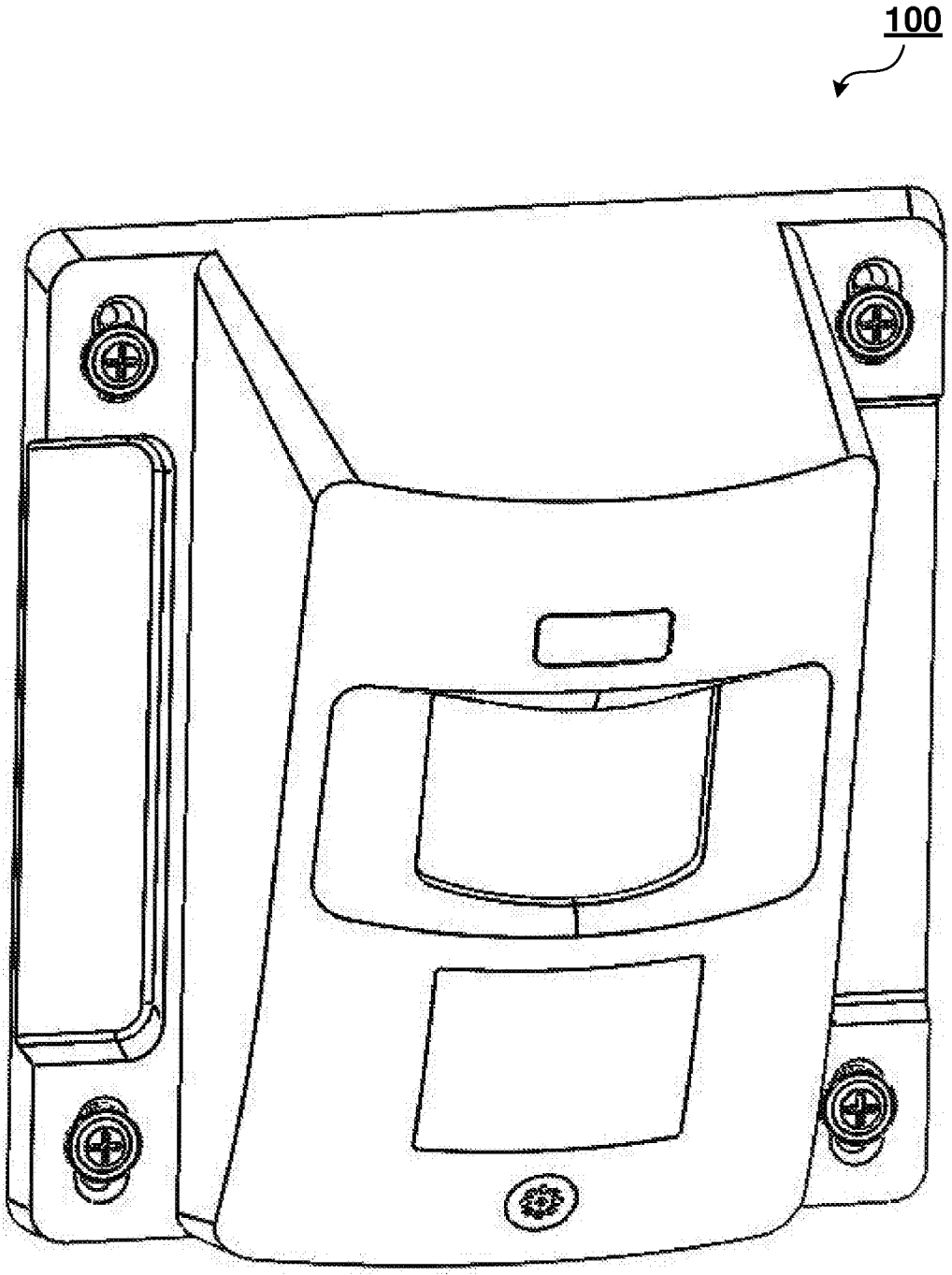
FIG. 4 is a perspective view of the monitoring device of FIG. 1.

FIGS. 2 and 3 are left and right hand side views, respectively, of the monitoring device 100. FIG. 4 is a perspective view of the monitoring device 100. It can be readily seen from FIGS. 2 to 4 that this implementation of the monitoring device 100 has a front panel 160 canted at an angle relative to a substantially vertical back panel 170. The canting of the front panel 160 relative to the back panel 170 directs the field of view of the monitoring device 100 towards the ground when the monitoring device 100 is affixed to a fixture in a vertical orientation at an elevated position. In one arrangement, the front panel 160 is canted at an angle of between 10° and 20°, and preferably 12° to 14° for a Fresnel type lens.

It will be appreciated by a person skilled in the art that the example of FIGS. 2 to 4 is one illustrative example of a housing for the monitoring device and other housing arrangements may equally be practised without departing from the spirit and scope of the present disclosure. In particular, different housing shapes with different back panels may be used, particularly when locating the monitoring device on different surfaces and/or at different locations, including, for example, walls, ceilings, beams, towers, poles, scaffolding, and the like. Further, other housing shapes may be adapted for placing the monitoring device 100 on a flat surface, such as a table or shelf. Such housing shapes may or may not have flat back panels and may or may not be adapted for securing to a wall or other fixture.

Depending on the intended application, the monitoring device 100 may have a lens with a fixed or adjustable field of view. For intended applications in which the monitoring device 100 is to be placed on a table or the like, the lens may be configured to provide a substantially horizontal field of view. In other applications in which the monitoring device 100 is to be placed at a relatively high vantage point, such as on a wall, the lens may be configured to include a downward field of view, either through positioning of the lens within the housing or the shape of the housing, or a combination thereof. In one arrangement, the monitoring device 100 includes an adjustment means for altering a field of view of the lens. Such an adjustment means may include, for example, a lever, a dial, or the like, which may be moved by a user to adjust the positioning of the lens to deliver a desired field of view.

Figure 5:
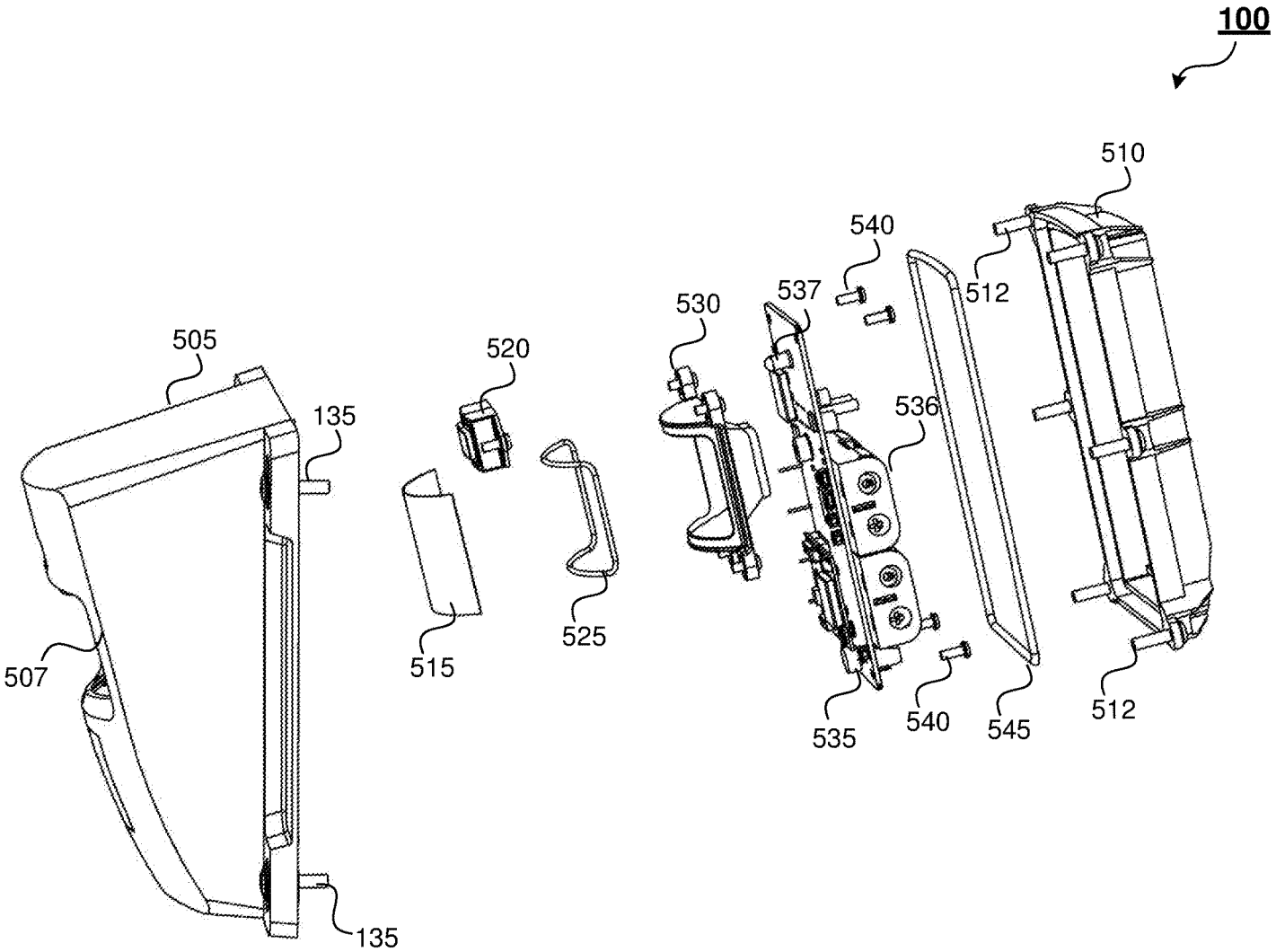
FIG. 5 is an exploded view of the monitoring device of FIG. 1.

FIG. 5 is an exploded view of the monitoring device 100, illustrating various components of this embodiment. In this embodiment, the protective housing 110 includes a front portion 505 having an aperture 507 for receiving a lens 515. Fasteners 135 pass through apertures in the front portion 505 to secure the monitoring device 100 to a fixture.

The monitoring device 100 also includes a PIR sensor 520, which is positioned behind the lens 515 in a lens housing 530. The PIR sensor 520 is protected from the elements by a lens gasket 525 positioned between the front portion 505, the lens 515 and the lens housing 530. The lens gasket 525 may be implemented, for example, using rubber or silicon tubing, or the like, such as would be apparent to a person skilled in the art. The lens housing 530 couples to a printed circuit board 535, which includes a power supply 536. The printed circuit board 535 also includes a light 537, which in this example is implemented using a single LED. The printed circuit board 535 optionally includes a buzzer/siren for issuing an audible alert. In one implementation, the buzzer/siren is located on a rear side of the printed circuit board 535 and the rear portion 510 has a corresponding aperture through which the buzzer/siren can emit sound. The aperture may be covered, for example, by a membrane, such as a Goretex sticker, to prevent moisture ingress.

The printed circuit board 535 further includes a microprocessor (microcontroller) for controlling operation of the monitoring device 100 and a wireless transceiver, such as a Sigfox transceiver. In the example of FIG. 5, the printed circuit board 535 also includes an internal antenna for receiving and transmitting wireless signals to and from the Sigfox transceiver.

In one arrangement, the printed circuit board 535 further includes a counter that maintains a count of the number of times the PIR sensor 520 has been activated and/or the number of times an optional microphone has been activated and/or an aggregate of all activations of a set of one or more sensors associated with the monitoring device 100. In one implementation, the counter is integral with the microcontroller. In an alternative implementation, the counter is external to the microcontroller. In a further arrangement, the counter is implemented on the remote server. Depending on the implementation, the counter or microcontroller may associate a timestamp with each activation, generating a log of activations (or "events").

In one arrangement, the PIR sensor 520 includes a counter that counts the number of times that the PIR sensor has been activated by detecting movement. The count is presented to a microcontroller at periodic intervals for the microcontroller to transmit to the remote server. The microcontroller then resets the counter of the PIR sensor 520 to a count of zero.

The example of FIG. 5 shows a set of retaining screws 540 for securing the printed circuit board 535 to the front portion 505, thus also securing each of the lens 525, the PIR sensor 520, the lens gasket 525, and the lens housing 530 located between the printed circuit board 535 and the front portion 505. The retaining screws 540 are adapted to engage with corresponding apertures, such as threaded holes, moulded into the front portion 505.

A housing gasket 545 is positioned between the front portion 505 and the rear portion 510, to assist in preventing or reducing the ingress of dust and moisture to the internal cavity of the monitoring device 100, in which the printed circuit board 535 is located. The housing gasket 545 may be implemented using a rubber or silicon strip or tubing. A plurality of fasteners 512 are used to secure the rear portion 510 to the front portion 505.

A rear side of the front portion 505 preferably extends beyond a rearmost surface of the rear portion 510, thus ensuring that one or more portions of the rearmost surface of the front portion 505 abut a fixture to which the monitoring device 100 is to be attached and also ensuring that the rear portion is not in contact with the fixture. Accordingly, any water that travels along a surface of the fixture will not come into contact with the rear portion 510, thus aiding in keeping the enclosed printed circuit board 535 dry.

Figure 6:
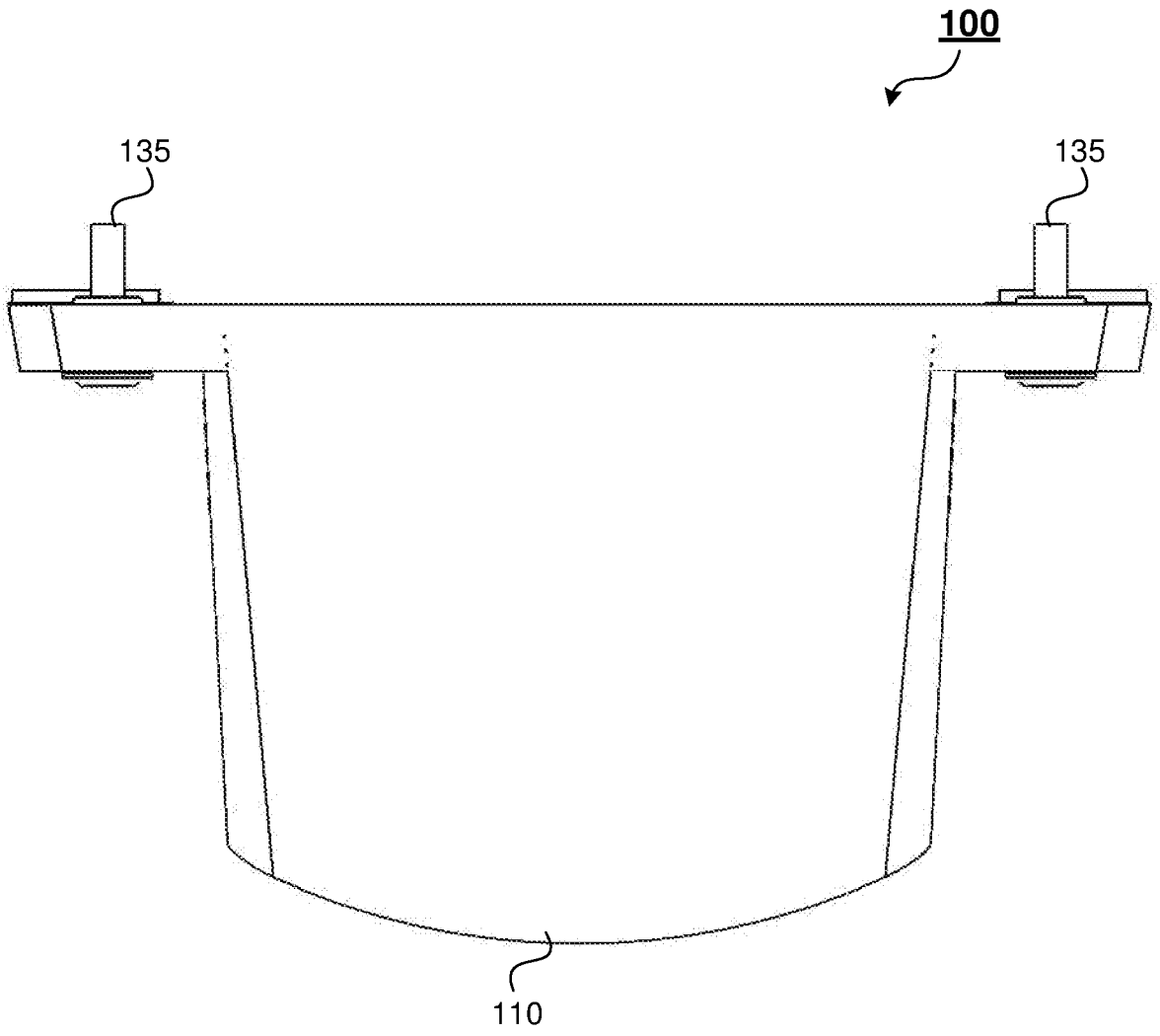
FIG. 6 is a top view of the monitoring device of FIG. 1.
Figure 7:
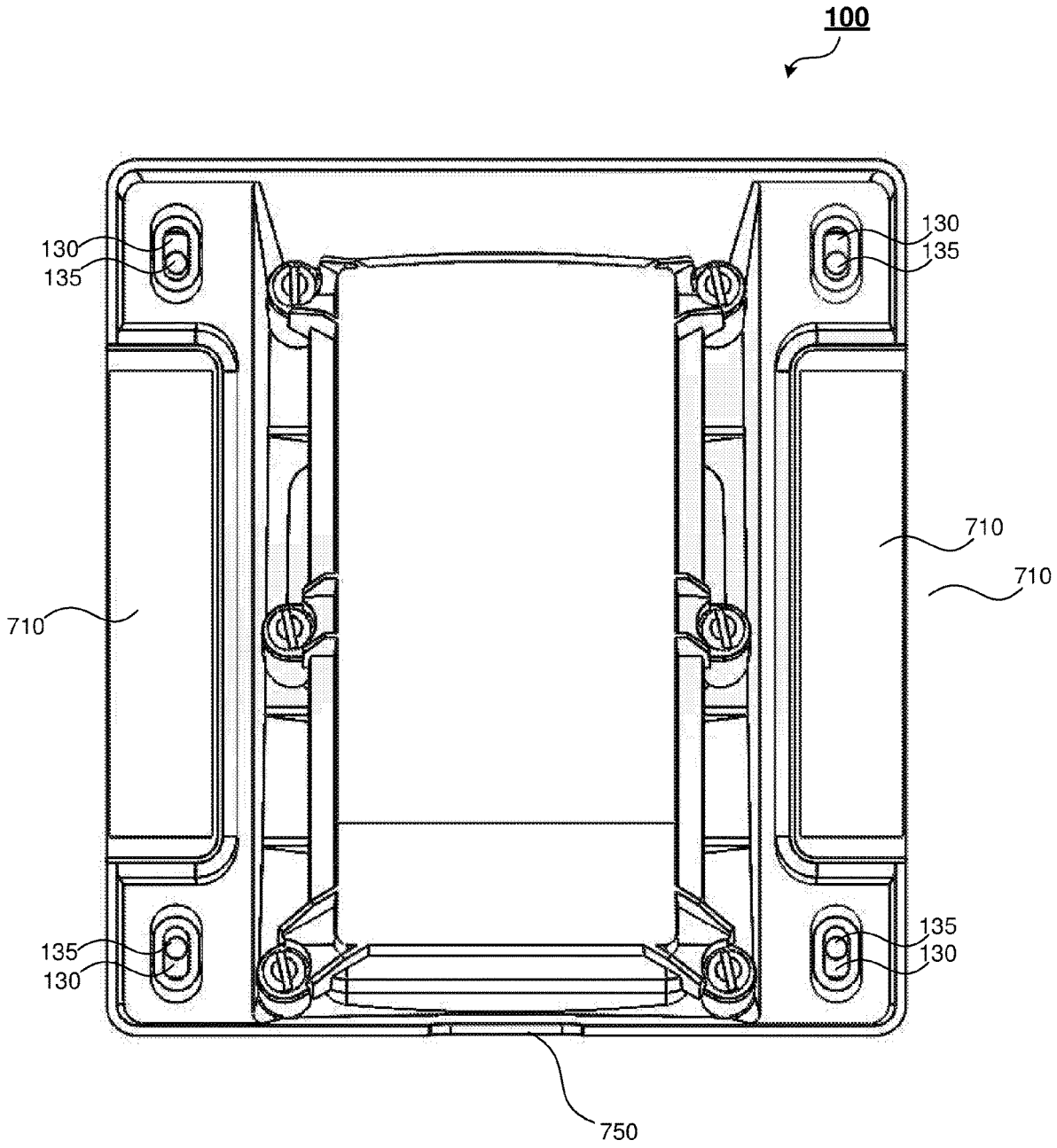
FIG. 7 is a rear view of the monitoring device of FIG. 1.

FIG. 6 is a top view of the monitoring device 100 and FIG. 7 is a rear view of the monitoring device 100. FIG. 7 shows substantially flat portions 710 to which may be applied an adhesive, such as double sided adhesive tape, so as to secure the monitoring device 100 to a fixture. The adhesive may be used alone or in combination with fasteners 135. Similarly, the screws 135 may be used to secure the monitoring device 100 to the fixture, without the assistance of any adhesive. FIG. 7 shows an optional cutaway region 750 at the base of the monitoring device 100, which allows any moisture that finds its way behind the monitoring device 100 to flow through and thus not be trapped.

Figure 8:
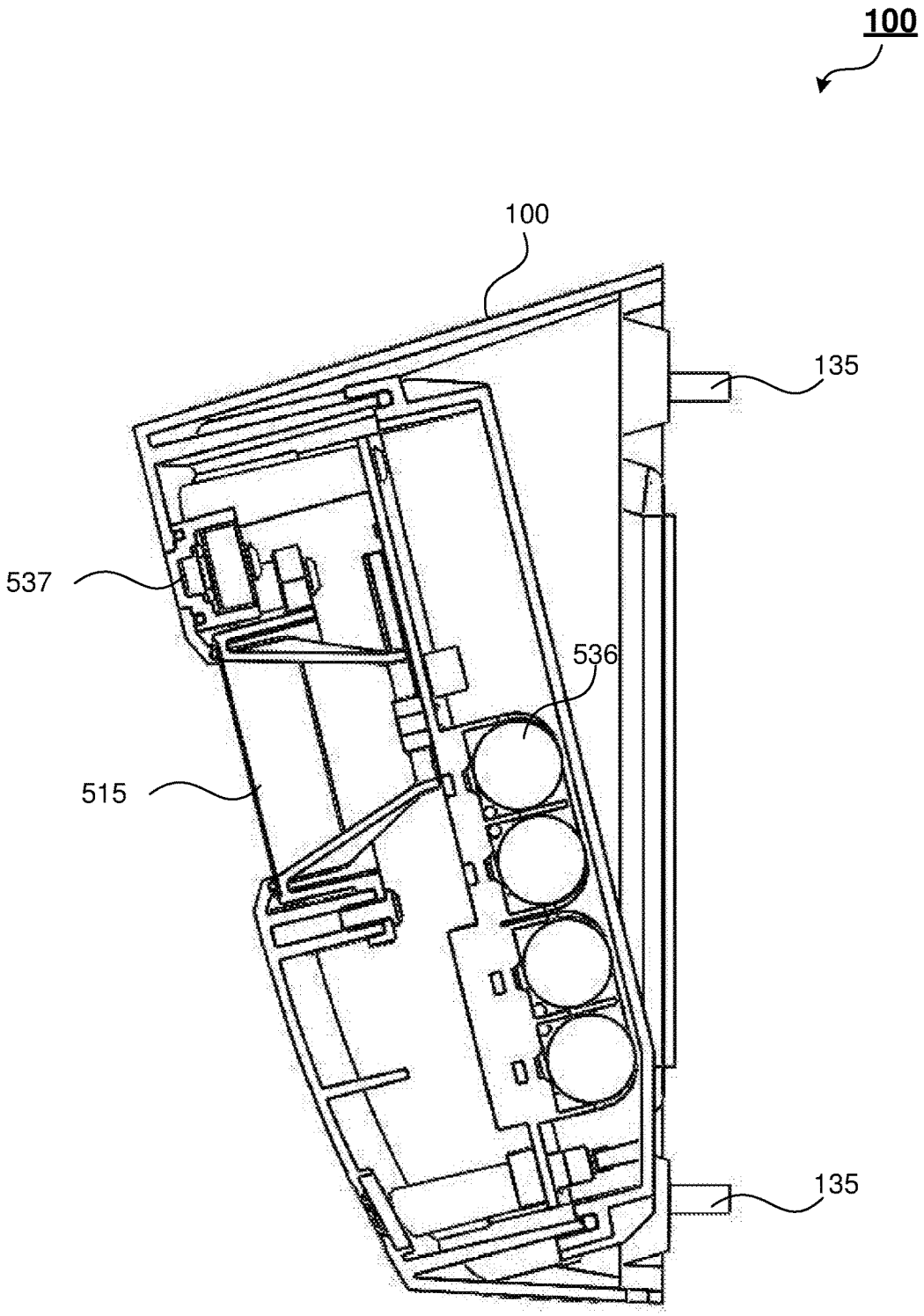
FIG. 8 is a cross-sectional view of the monitoring device of FIG. 1, through the axis A-A'.

FIG. 8 is a cross-sectional view of the monitoring device 100 of FIG. 1, through the axis A-A'. FIG. 8 shows, inter alia, the lens 515, the light 537, the power supply implemented as four AA batteries 536, and fasteners 135 for securing the monitoring device 100 to a fixture. As described above with reference to the light 150, the light 537 optionally includes a light sensor for detecting changes in ambient light levels in the environment surrounding the monitoring device 100.

Figure 9:
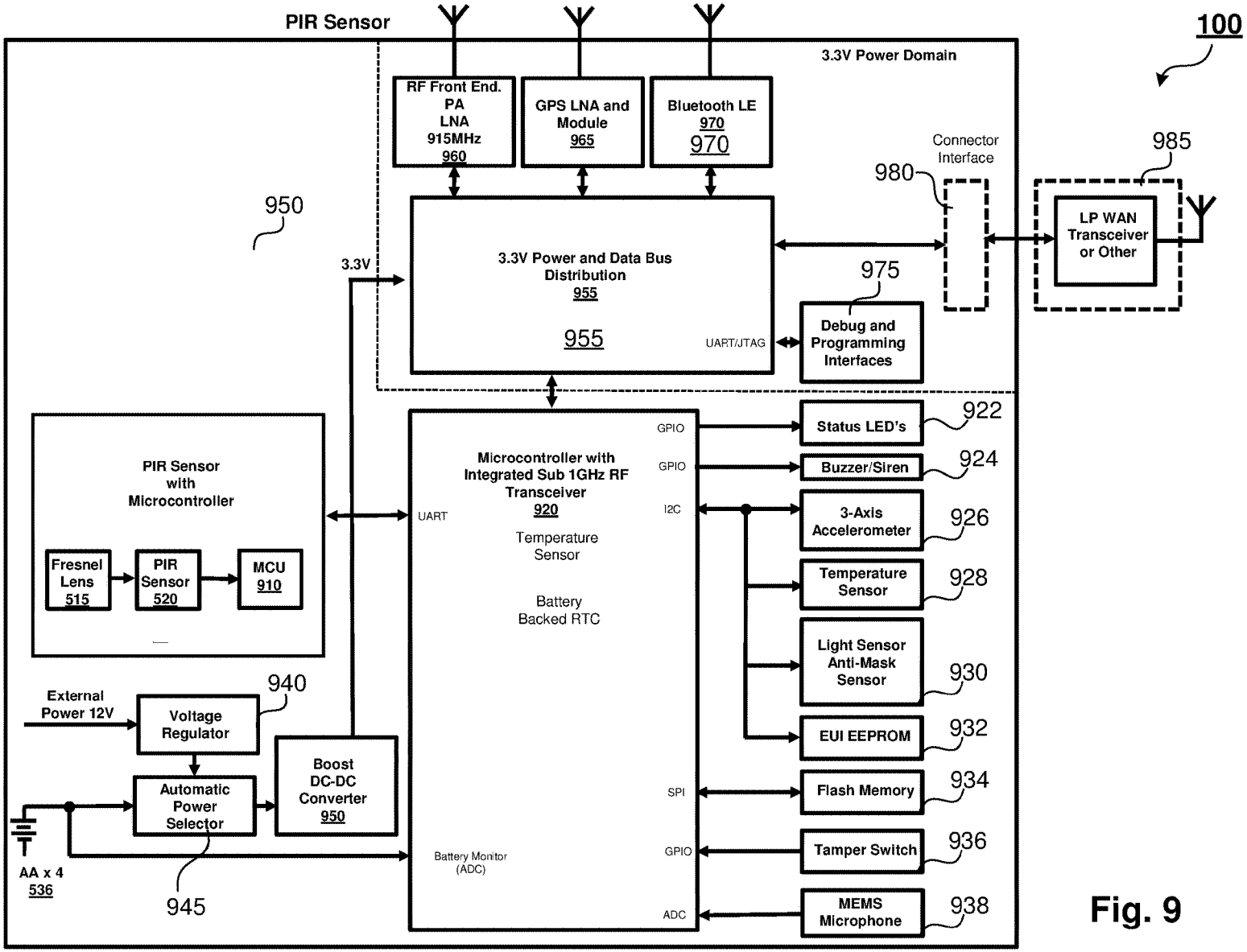
FIG. 9 is a schematic block diagram of functional modules of a monitoring device.

FIG. 9 is a schematic block diagram of functional modules of the monitoring device 100 of FIG. 1. The monitoring device 100 includes the power supply 536 in the form of 4 AA batteries. In the example of FIG. 9, the monitoring device 100 includes an optional external power supply that is adapted to provide external power, such as from a mains power supply or a DC power supply. The optional external power supply is received by a voltage regulator 940, which presents regulated power to an automatic power selector 945. The automatic power selector selects power from the batteries 536 or the external power via the voltage regulator 940 for use in the monitoring device 100.

The monitoring device 100 includes the Fresnel lens 515 and the PIR sensor 520, which is coupled to a microprocessor 910. The microprocessor 910 executes application software, which provides flexible motion detection that can be configured by a user. It will be appreciated that other PIR sensors and PIR sensor implementations may equally be utilised.

The power supply 536 couples to a microcontroller 920, which in this embodiment is implemented using a microcontroller with an integrated sub 1 GHz RF transceiver. In this embodiment, the microcontroller 920 includes an integrated wireless transceiver. In alternative embodiments, a separate wireless transceiver may be used. Further, as in this embodiment, the integrated wireless transceiver of the microcontroller 920 may be supplemented by an external wireless transceiver 960 to increase operational range.

The microcontroller 920 receives information from the PIR sensor 520 to indicate when the PIR sensor 520 has detected an object. In the embodiment of FIG. 9, the microcontroller 920 is also coupled to a set of one or more status LEDs 922, a buzzer 924, an accelerometer 926, a temperature sensor 928, a light sensor 930, an EUI EEPROM 932, a flash memory 934, a tamper switch 936, and a microphone 938, such as a micro-electromechanical systems (MEMs) microphone.

The microcontroller 920 is also coupled to a power and data bus distribution buffer 955, which receives an input from an optional Boost DC-DC converter 950. The Boost DC-DC converter 950 provides additional power to operate one or more peripherals, such as the sensor devices 922 . . . 938. In particular, the Boost DC-DC converter 950 maintains a constant DC voltage when power from the batteries 536 drops. The power and data distribution buffer 955 is also coupled to each of the wireless transceiver 960, a GPS LNA module 965, and a Bluetooth Low Energy (LE) module 970. Further, the power and data bus distribution buffer 955 couples to a debug and programming interfaces module 975. The debug and programming interfaces module 975 allows software uploads, such as firmware updates and configuration changes. The wireless transceiver may be implemented, for example, using a radiofrequency (RF) front end power amplifier (PA) or low noise amplifier (LNA), and may operate, for example, at 915 MHz. The wireless transceiver 960 may be implemented using, for example, one of 3G, 4G, Wi-Fi, Bluetooth, LTE, or Low-Power Wide-Area Network (LPWAN) technologies, such as LTE-MTC, LoRa, NarrowBand IoT, 6 LowPAN, or Sigfox.

The accelerometer 926 may be implemented using a 3-axis accelerometer to detect shock applied to the monitoring device 100. In one arrangement, the accelerometer 926 is implemented using the LIS2DH from ST-Microelectronics. On detecting a shock in excess of a predefined shock threshold, the accelerometer 926 transmits a shock signal to the microcontroller 920, such that an alert signal may be transmitted via the wireless transceiver 960 to a remote server.

The microphone 938 is adapted to detect noises in proximity to the monitoring device 100. The microphone 938 may include an onboard microphone with a front end gain and filtering stage. In one arrangement, the microphone 938 is coupled to an analog to digital conversion (ADC) input port of the microcontroller 920. When the microcontroller 920 receives a sound signal from the microphone 938 in excess of a predefined sound threshold, corresponding to a predefined audio signature, or indicative of a transition from a background sound level, indicative of glass shattering, a falling object, or forced entry, the microcontroller 920 generates an alert signal for transmission to the remote server via the wireless transceiver 960. In one implementation, one or more filters are applied to audio signals received by the microphone 938 in order to determine whether a received audio signal is above or below a predefined threshold or within a predefined range. The filters may relate to frequency, amplitude, or a combination thereof.

A predefined audio signature may correspond, for example, to a predefined audio tone or sequence of tones. Such tone or tones may be programmed in to the monitoring device 100 at the time of manufacture or may be learnt in the field and stored in firmware. In one arrangement, the predefined audio signature corresponds to a personal alarm device that emits an alert tone when activated by a user. In one implementation, the user activates a learning mode of the monitoring device 100 and then activates the personal alarm device, whereupon the alert tone emitted by the personal alarm device is received by the microphone 938 and stored in flash memory of the monitoring device 100. When the microcontroller 920 receives a sound signal from the microphone 938, the microcontroller 920 compares the received sound signal to one or more audio signatures stored in flash memory and generates an alert signal if the microcontroller 920 identifies a match between the received sound signal and a stored audio signature.

In one arrangement, the microcontroller 920 is configured to register an event when the microphone 938 receives an audio signal in excess of, for example, 80 to 85 decibels. Registering an event may result in incrementing a counter, which may be an onboard counter integral with the microcontroller 920 or external to the microcontroller 920. As described above, the counter or microcontroller 920 may associate a timestamp with each event. In such an implementation, the monitoring device 100 stores a log of events. Alternatively, the remote server stores a log of events based on received alerts from a set of one or more monitoring devices 100.

In one implementation, the microcontroller 920 is controlled by software and/or firmware such that the microcontroller 920 issues an alert once the microcontroller 920 detects a predefined number of audio signals in excess of a predefined sound threshold within a predefined time period. In one example, the alert corresponds to detecting an audio signal corresponding to a predefined frequency and amplitude within a predefined time period. In one particular example, the audio signal corresponds to three claps from human hands above a sound level of 80 db within a 30 second period. The predefined audio level may be adjusted dependent on how far the monitoring device 100 is to be positioned from a point or area of interest.

In one arrangement, the microcontroller 920 sends an alert corresponding to an activation resulting from either movement detection or an audio trigger, whereupon the remote server receiving the alert increments a counter that counts the number of alerts.

In one arrangement, the PIR sensor 520 includes a counter and the PIR sensor 520 periodically transmits a current count from the counter to the microcontroller 920. The microcontroller 920 then transmits the periodic count via an integrated wireless transceiver or via the external antenna 960 or via the Bluetooth module 970. The microcontroller 920 resets the counter on the PIR sensor 520 to zero, so that the PIR sensor can count the number of movement activations for the next period.

The light sensor 930 detects ambient light levels in the environment surrounding an operational location of the monitoring device 100. Based on light readings from the light sensor 930, the microcontroller 920 differentiates between night and day. The microcontroller 920 optionally detects the presence of light during the night, such as may occur from a trespasser's headlights or torch. The microcontroller 920 can then issue an alert message. Further, the light sensor 930 optionally includes or is implemented as an anti-mask sensor, which detects the presence of an object placed close to the monitoring device 100 in order to block (or "mask") the field of view of the monitoring device 100. Detection of such an object is often related to a malicious intent to disable the monitoring device 100, so an anti-mask sensor is used to generate an alert under such circumstances.

The optional temperature sensor 928 measures ambient temperature of the local environment in which the monitoring device 100 is positioned. If the temperature is outside a predefined operating range, the microcontroller 920 issues an alert signal.

The optional GPS module 965 enables the microcontroller 920 to send geographical position updates regarding the monitoring device 100 to the remote server.

The Bluetooth LE module 970 provides a short range wireless communication interface by which to provide on-site access to monitor and update settings of the monitoring device 100. In one arrangement, the monitoring device 100 includes a pairing switch, which when depressed seeks to pair with a Bluetooth enabled device within range of the monitoring device 100.

The EUI EEPROM 932 stores configuration parameters for the monitoring device 100. Further, the EUI EEPROM 932 and/or flash memory 934 can be used to store event logs generated by the microcontroller 920.

In one arrangement, the power and data bus distribution buffer 955 optionally couples to a Modular Stack (MS) connector interface module 980 for coupling to one or more optional external MS modules 985, such as an MS Sigfox transceiver.

In use, the tamper switch 936 is activated when the device is positioned in a location for use. In one arrangement, closure of the rear portion 510 causes depression of a switch to activate the tamper switch 936. The tamper switch 936 activates the buzzer 924 when tampering is detected. The tamper switch 936, upon detecting tampering, may also send a tampering signal to the microcontroller 920 to cause an alert signal to be transmitted via the wireless transceiver 960 to the remote server.

In one arrangement, the status LEDs 922 include one or more of the following:

- a motion status LED, indicating status of PIR sensor 520;
- system status LED, indicating a general system status;
- communications LED, indicating a status of a wireless communications link; and
- MS LED, indicating a status of any external MS devices 985.

In one arrangement, the monitoring device 100 has two modes of operation:

(i) armed mode; and (ii) off mode.

Further, at all times, the monitoring device 100 operates with a heart beat mode.

The armed mode is the normal mode of operation, during which the monitoring device 100 is set to detect events triggered by one or more of the sensors, such as the PIR sensor 520, accelerometer 926, temperature sensor 928, light sensor 930, and tamper switch 936.

In one arrangement, the monitoring device 100 generates an alert message upon detection of a valid motion event by the PIR sensor 520, whereby a valid motion event is a set of low frequency motion events occurring over a predefined period of time, such as 2 seconds. On detection of a valid motion event, the PIR sensor 520 wakes the microcontroller 920 from a low power mode, whereupon the microcontroller 920 optionally takes readings from one or more peripherals.

Table 1 below provides a sample list of actions performed upon the microcontroller 920 being woken by one or more of the sensors in the monitoring device 100, including, for example, the PIR sensor 520, the accelerometer 926, the temperature sensor 928, the light sensor 930, or the tamper switch 936.

TABLE 1

| Peripheral | Purpose | Action on validation |
|---|---|---|
| IR/Light Sensor | Perform anti-mask detection and white light immunity | Trigger Alarm notify (Anti-mask, if triggered for long duration) |
| Microphone | Listen for loud noises | Trigger Alarm notify |
| PIR Sensor | Motion Detection | Trigger Alarm notify |
| Accelerometer | Detect tampering to unit | Trigger Alarm notify |
| Tamper Switch | Detect that enclosure has been opened | Trigger Alarm notify |

The off mode of operation sets the monitoring device 100 to a low power operation mode, where motion scanning by the PIR sensor 520 is disabled. During the off mode, other sensors, such as the microphone 938, light sensor 930, and tamper switch 936, can wake the microcontroller 920 upon detection of an event.

As noted above, the monitoring device 100 always operates a heart beat mode, in which a real time clock (RTC) on the printed circuit board 535 periodically wakes the microcontroller 920, so that the microcontroller 920 can generate a heart beat message to the remote server.

The presence of an onboard clock enables a user to configure the monitoring device 100 to be in the armed mode according to one or more predefined schedules. For example, the user may configure the monitoring device 100 to be in the armed mode from 6 pm to 6 am on weekdays and 24 hours over the weekend. Operating schedules may be preconfigured or user-selectable, or a combination thereof.

Figure 10:
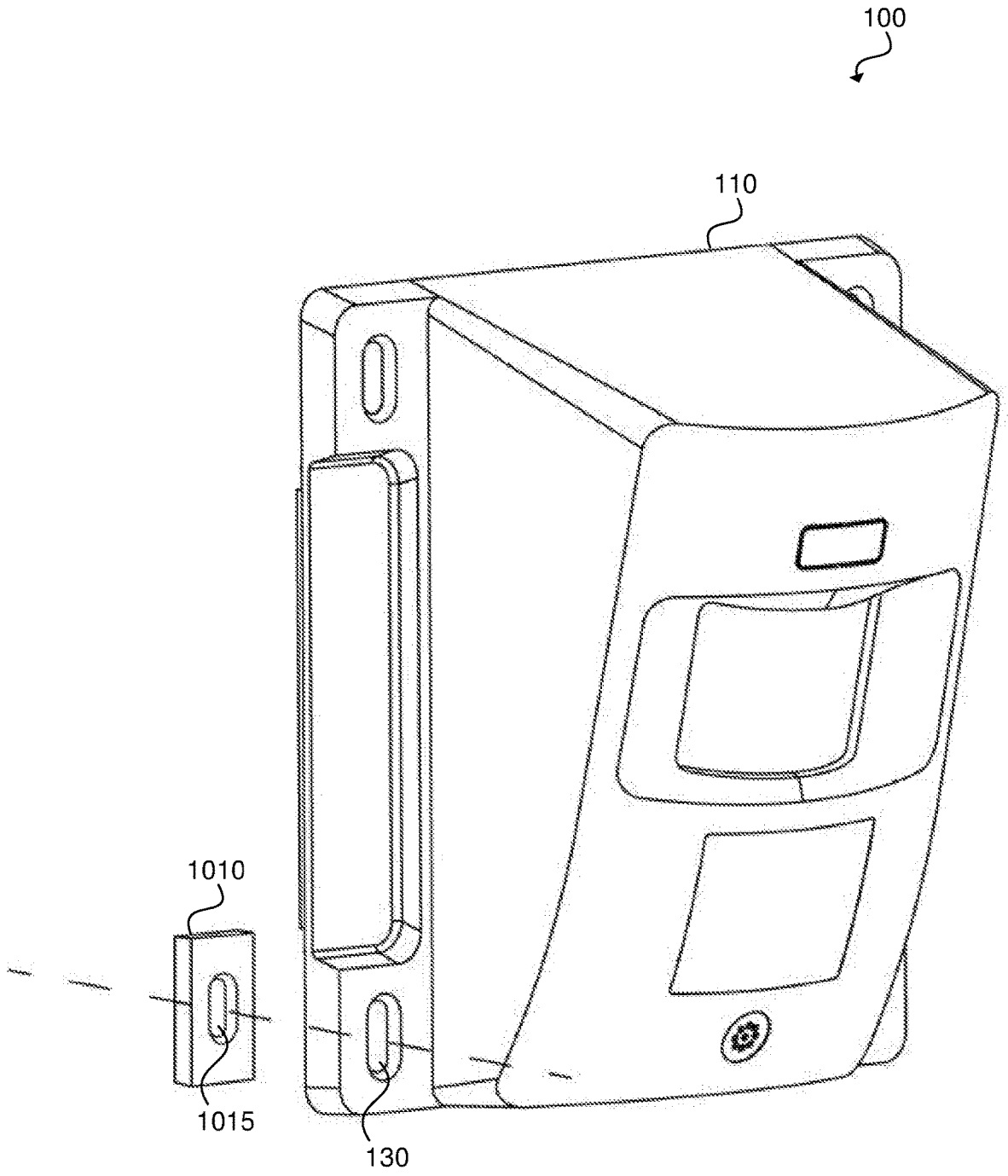
FIG. 10 is a schematic block diagram representation of a monitoring device with a packing plate.

FIG. 10 is a schematic block diagram representation of a monitoring device 100 having a protective housing 110 with an optional first packing plate 1010. In the example of FIG. 10, the first packing plate 1010 is placed between a bottom left region of the housing 110 and a fixture (not shown) to which the housing is to be secured. A corresponding second packing plate (not shown) is placed between a bottom right region of the housing 110 and the fixture, such the first and second packing plates position the bottom of the housing 110 further from the fixture than the top of the housing 110. In this example, each packing plate 1010 has a packing plate aperture 1015, such that a fastener 135 may pass through an aperture 130 of the housing and the packing plate aperture 1015 to secure the first packing plate 1010 in position.

It will be appreciated that any combination of packing plates may be placed between the housing 110 and the fixture, in order to position the monitoring device 100 at a desired angle relative to the fixture. Further, packing plates of different thicknesses may be utilised. The packing plates may be placed at the bottom, top, or edges of the housing 110, or any combination thereof.

Figure 11:
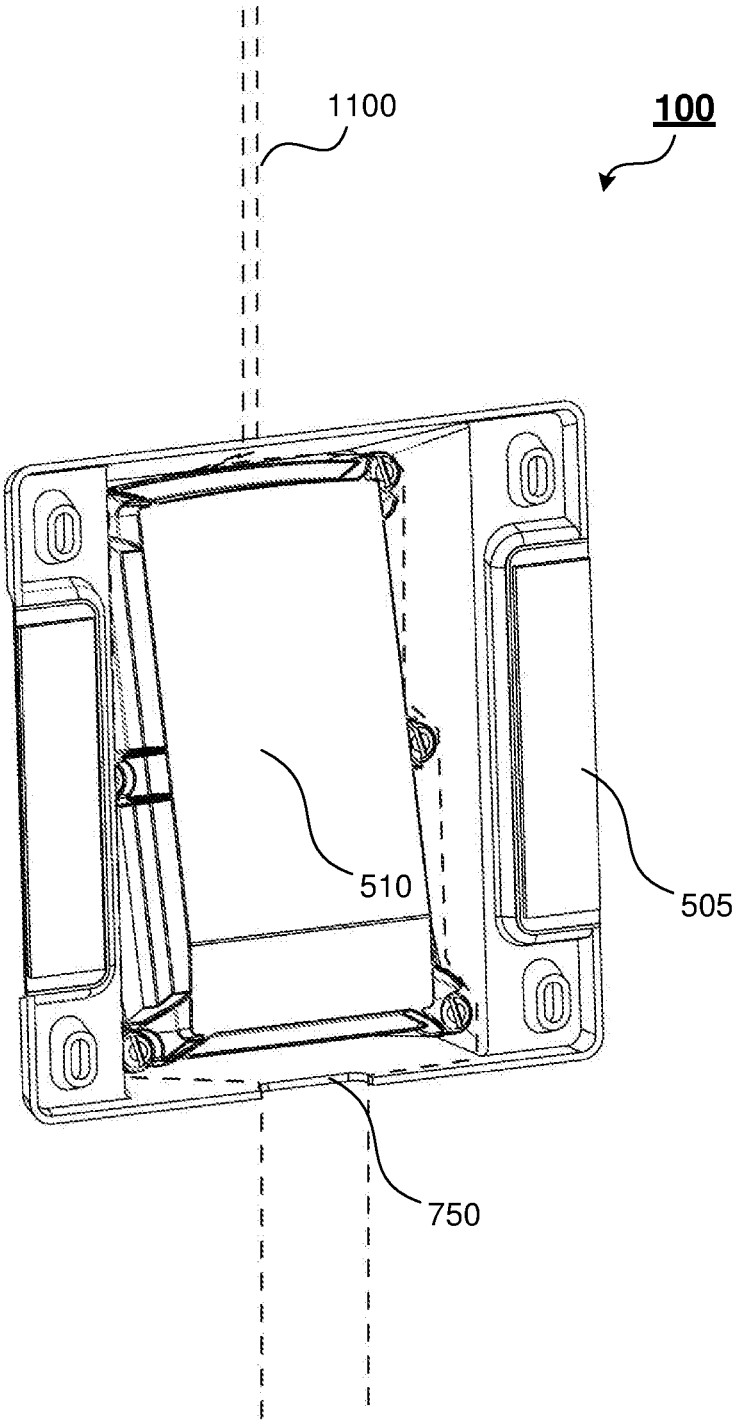
FIG. 11 is a schematic block diagram illustrating water flow around a back of a monitoring device.

FIG. 11 is a schematic block diagram illustrating water flow around a back of the monitoring device 100. In this example, a stream of water 1100 flows from above the monitoring device 100. Any water that passes between the back of the monitoring device and a fixture to which the monitoring device 100 is secured flows along channels formed between the front portion 505 and the rear portion 510. The water 1100 then flows through the cutaway region 750, which prevents the water 1100 from being contained between the monitoring device 100 and the fixture.

Figure 12:
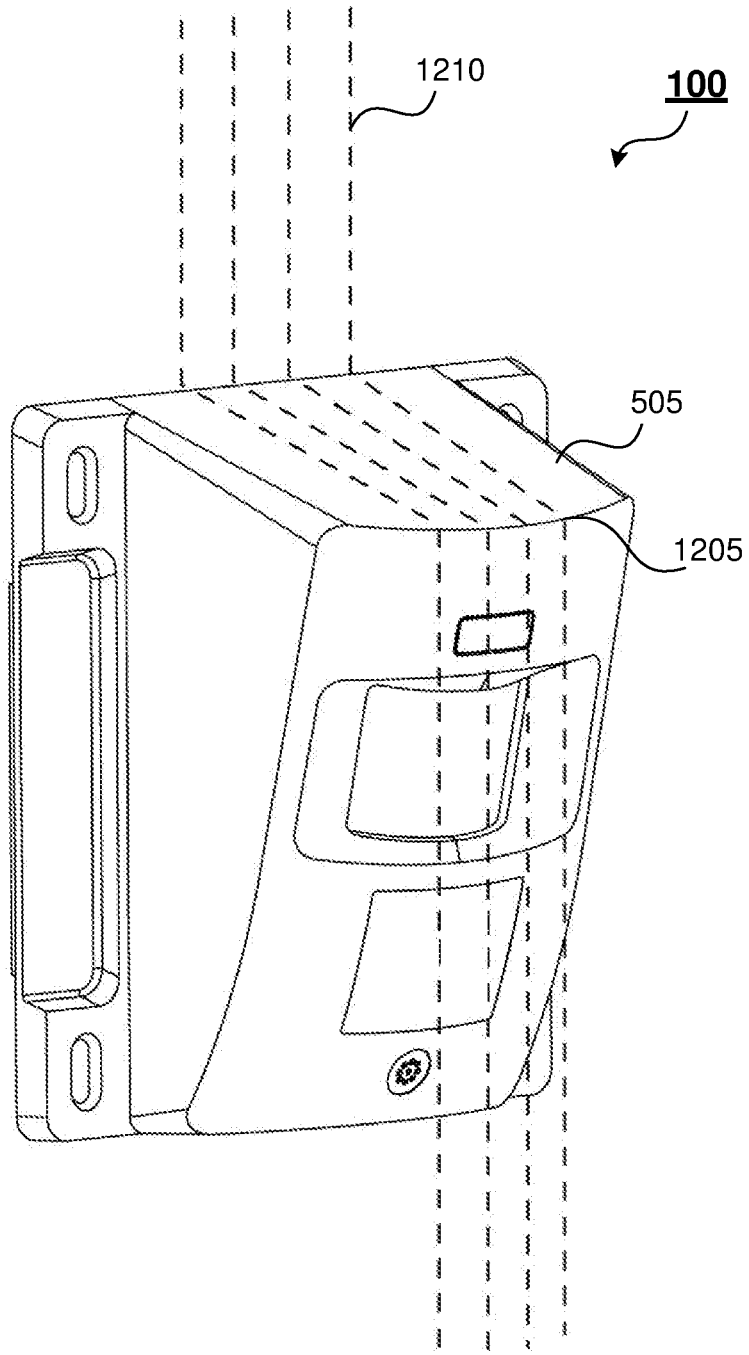
FIG. 12 is a schematic block diagram illustrating water flow around a front of a monitoring device.

FIG. 12 is a schematic block diagram illustrating water flow around a front of the monitoring device 100. In the example of FIG. 12, the front portion 505 of the monitoring device 100 is shaped so as not to retain water on its surface. Water 1210 incident on a top of the front portion 505 flows across the top and falls freely from a front edge 1205 of the front portion 505.

Figure 13:
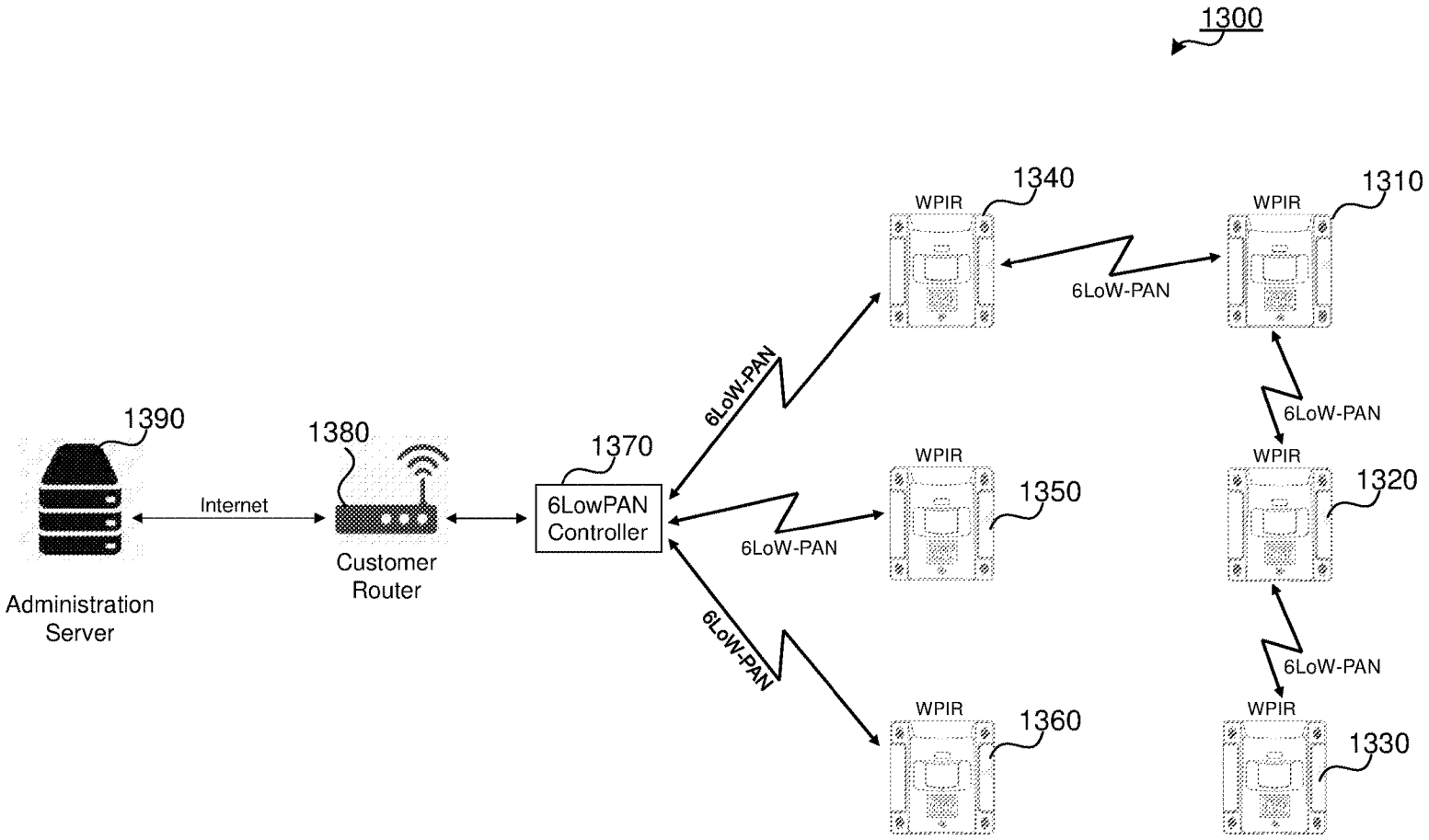
FIG. 13 is a schematic block diagram representation of a system implemented using a set of monitoring devices using the 6LowPAN signalling protocol.

FIG. 13 is a schematic block diagram representation of a system 1300 implemented using a set of monitoring devices 1310, . . . , 1360 using the 6LowPAN signalling protocol. Each of the monitoring devices 1310, . . . , 1360 includes a 6LowPAN transceiver and is able to communicate with one or more of the other monitoring devices 1310, . . . , 1360. This enables a plurality of monitoring devices to be daisy-chained.

In the example of FIG. 13, the system 1300 includes a 6LowPAN controller 1370 that is coupled to a customer router 1380, which is, in turn, coupled via a communications network, such as the Internet, to an administration server 1390. The 6LowPAN controller 1370 may be coupled to the router 1380 via one or more wired or wireless communications links, including, but not limited to, a Local Area Network (LAN), a Wide Area Network (WAN), a virtual private network (VPN), a cellular telephony network, the Internet, or any combination thereof. In a simple embodiment, the controller 1370 is located proximal to the server 1390 and coupled via a direct communications link, in which case the customer router 1380 and Internet connection may not be required.

In the example of FIG. 13, monitoring device 1330 communicates with monitoring device 1320, which in turn communicates with monitoring device 1310. The monitoring device 1301 communicates with the monitoring device 1340, which in turn communicates with the 6LowPAN controller 1370. Similarly, each of the monitoring devices 1350 and 1360 communicates directly with the 6LowPAN controller 1370.

Whilst the communication among the monitoring units 1310, . . . , 1360 and the controller 1370 is illustrated as being via 6LowPAN wireless signalling connections, communication may equally occur through wired connections, such as the Ethernet, or a combination of wired and wireless connections.

The monitoring devices 1310, . . . , 1360 detect activity within their respective fields of view or range of operation. Each of the monitoring devices 1310, . . . , 1360 sends a periodic heart beat message via the controller 1370 and router 1380 to the administration server 1390. In one implementation, a user is able to access the administration server 1390 via a computing device coupled to the Internet to view data derived from the monitoring devices 1310, . . . , 1360 and/or configure operating parameters of one or more of the monitoring devices 1310, . . . , 1360. Alternatively, or additionally, a user uses a computing device with a Bluetooth or Wi-Fi connection to communicate with each monitoring device 1310, . . . , 1360 to configure parameter settings.

On detecting a trigger condition, a monitoring device 1310, . . . , 1360 sends an alert message via the controller 1370 and the router 1380 to the administration server 1390. The administration server 1390 generates an alarm, such as sending an electronic message, or issuing a visual and/or audible alarm on a graphical user interface associated with an application executing on the server 1390 or a computing device associated with the server 1390.

Figure 14:
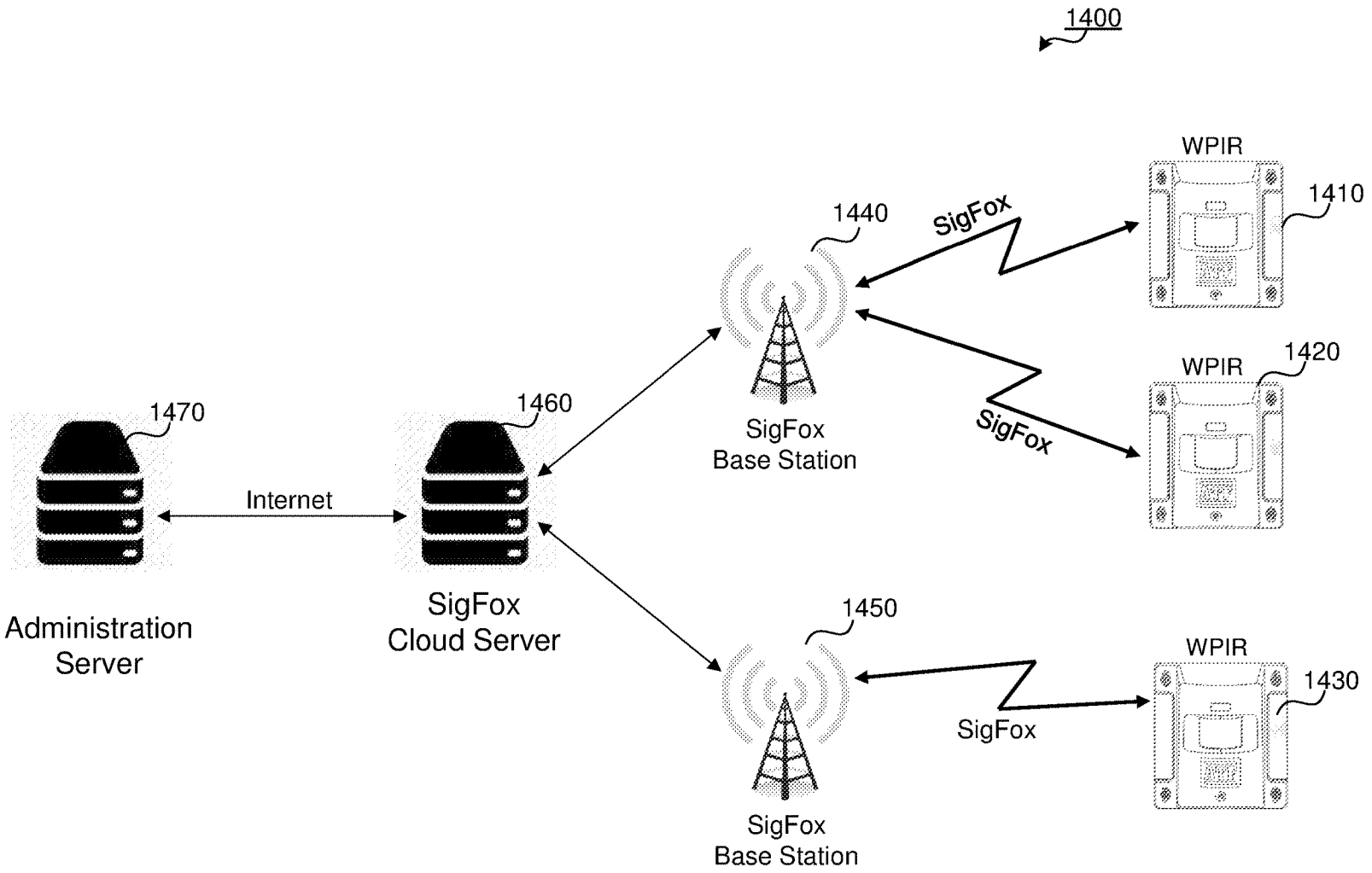
FIG. 14 is a schematic block diagram representation of a system implemented using a set of monitoring devices using the Sigfox signalling protocol.

FIG. 14 is a schematic block diagram representation of a system 1400 implemented using a set of monitoring devices 1410, . . . , 1430 using Sigfox signalling protocol. In this example, first and second monitoring devices 1410, 1420 are positioned within Sigfox transmission range of a first Sigfox base station 1440. A third monitoring device 1430 is positioned within Sigfox transmission range of a second Sigfox base station 1450. The first and second Sigfox base stations 1440, 1450 are coupled to a Sigfox server, which in turn communicates via the Internet with an administration server 1470.

The monitoring devices 1410, 1420, 1430 detect activity within their respective fields of view or range of operation. Each of the monitoring devices 1410, 1420, 1430 sends a periodic heart beat message via the respective base stations 1440, 1450 and the Sigfox server 1460 to the administration server 1470. In one implementation, a user is able to access the administration server 1470 via a computing device coupled to the Internet to view data derived from the monitoring devices 1410, 1420, 1430 and/or configure operating parameters of one or more of the monitoring devices 1410, 1420, 1430. Alternatively, or additionally, a user uses a computing device with a Bluetooth or Wi-Fi connection to communicate with each monitoring device 1410, 1420, 1430 to configure parameter settings.

On detecting a trigger condition, a monitoring device 1410, 1420, 1430 sends an alert message via the respective base station 1440, 1450 and Sigfox server 1460 to the administration server 1470. The administration server 1470 generates an alarm, such as sending an electronic message, or issuing a visual and/or audible alarm on a graphical user interface associated with an application executing on the server 1470 or a computing device associated with the server 1470.

One application relates to the use of one or more monitoring devices for detecting irregular activity in a monitored area. In one arrangement, a set of one or more monitoring devices is provided, as described above, wherein each monitoring device includes a wireless transmitter for communication with a RF gateway. The gateway is coupled to a remote server via a communication link, which may include one or more wired or wireless transmission media, or any combination thereof.

The remote server stores a schedule of regular activity. Depending on the implementation, the schedule may be a predefined schedule configured during an initial setup or installation phase. In another implementation, a user associated with the set of monitoring devices accesses a website associated with the remote server to define a schedule. Upon detecting movement or an audio signal, as described above, a monitoring device sends a message to the remote server, via the RF gateway. The remote server processes the received message relative to a stored schedule associated with the monitoring device that issued the message and determines whether to issue an alert.

Figure 15:
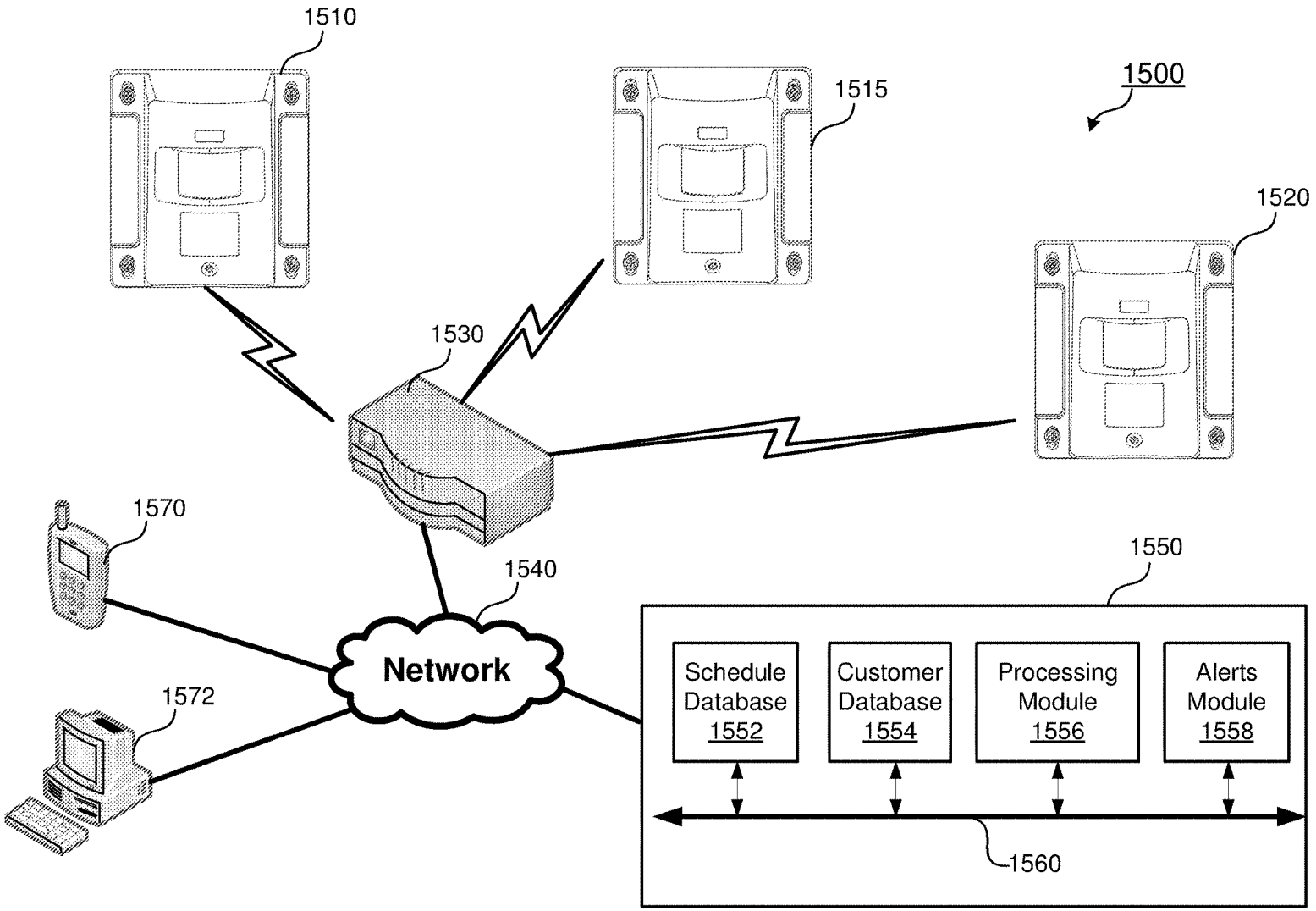
FIG. 15 is a schematic block diagram representation of a system implemented using a set of monitoring devices positioned in a home.

FIG. 15 is a schematic block diagram representation of a system 1500 implemented using a set of monitoring devices positioned in a home of an elderly user. In this example, the system 1500 includes a set of monitoring devices 1510, 1515, and 1520, which are positioned in selected locations throughout the home. Each of the monitoring devices 1510, 1515, 1520 is implemented using a wireless transceiver adapted to communicate with a RF gateway 1530. The RF gateway 1530 is coupled to a remote server 1550 via a communications network 1540. The communications network 1540 may include one or more wired or wireless communications links, including, but not limited to, a Local Area Network (LAN), a Wide Area Network (WAN), a virtual private network (VPN), a cellular telephony network, the Internet, or any combination thereof.

The remote server 1550 includes a customer database 1554, a processing module 1556, and an alerts module 1558. Each of the schedule database 1552, customer database 1554, processing module 1556, and alerts module 1558 may communicate with each other via a bus 1560, or other means.

Depending on the implementation and the wireless communication protocol used, the RF gateway 1530 may be positioned in the home or at a nearby location. In one implementation, the transmission protocol is based on the IEEE 802.15.4 standard for low-rate wireless personal area networks (LR-WPANs), having a range in excess of 100 metres. In one particular implementation, the home is a villa in a retirement village, wherein the RF gateway 1530 is positioned in a central location, such that the RF gateway is adapted to exchange wireless communications with multiple sets of monitoring devices from multiple villas in the retirement village.

In the example of FIG. 15, the remote server 1550 is associated with a website by which a user is able to register with the server, a software application ("app") executable on a computing device, or a combination thereof. The registered user is able to use a computing device, such as a smartphone 1570 or personal computer 1572, to access the website or app to configure one or more settings associated with each of the monitoring devices 1510, 1515, and 1520.

The registered user is also able to define a schedule of ordinary activity or modify a default schedule of ordinary activity. The schedule of ordinary activity is stored in the schedule database 1552 in the remote server 1550 and is associated with a user profile associated with the registered user and stored in the customer database 1554. The schedule of ordinary activity defines periods throughout a day during which a certain level of activity or inactivity is expected from the user. Software executing on the processing module 1556 of the remote server is then able to use the stored schedule of ordinary activity to determine whether to issue an alert from the alerts module 1558, based on a level of activity or inactivity as detected by the set of monitoring devices 1510, 1515, 1520. The alerts module 1558 issues an alert, which may be an electronic message transmitted via the network 1540 to one or both of the smartphone 1570 and personal computer 1572 associated with the user.

Figure 16:
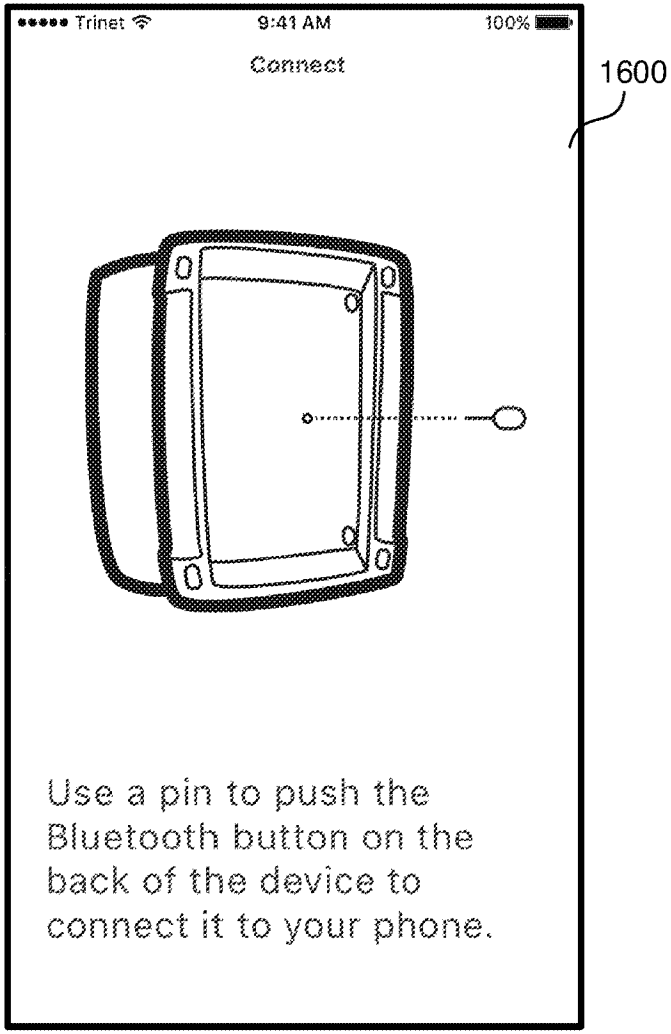

FIG. 16 is a screenshot 1600 from an app associated with the remote server 1550 executing on a mobile computing device, such as a smartphone. The screenshot 1600 instructs the user how to pair one of the monitoring devices 1510, 1515, 1520 to the mobile computing device. In this example, the user is instructed to press a button on a rear panel of the monitoring device in order to activate a Bluetooth pairing mode.

Figure 17:
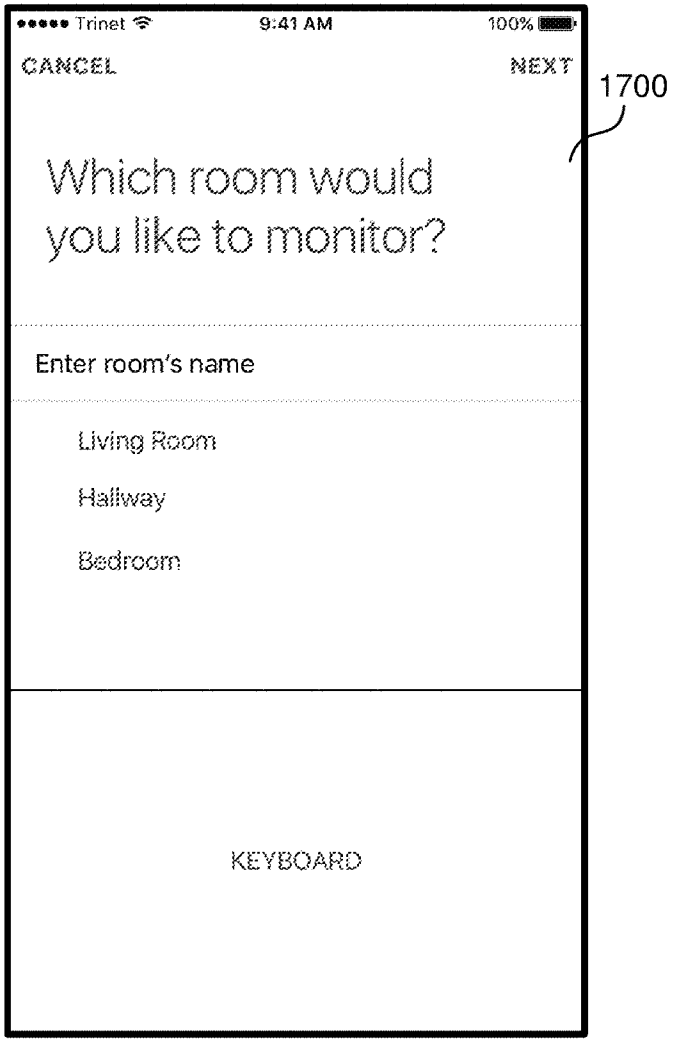
FIGS. 16 to 28 are screenshots associated with a software application for configuring and managing a monitoring system implemented with a set of one or more monitoring devices.

FIG. 17 is a screenshot 1700 that provides the user with a graphical user interface by which to select one or more rooms within the house that are to be monitored. In this example, the screenshot 1700 provides the user with a selection of: Living Room, Hallway, and Bedroom, corresponding to the locations in which the monitoring devices 1510, 1515, 1520 have been positioned. As described above, the housing shapes of the monitoring devices 1510, 1515, 1520 may differ, depending on the locations in which the monitoring devices 1510, 1515, 1520 are to be positioned.

In home environments, the monitoring devices 1510, 1515, 1520 may be positioned on walls, on tables, shelves, on or in ceilings, and the like. Depending on the application, the monitoring devices 1510, 1515, 1520 may be positioned to have a field of view of a whole room, a doorway, entrance way, or other passage. One or more of the monitoring devices 1510, 1515, 1520 may also be positioned in a cupboard, in order to detect access to the cupboard.

Figure 18:
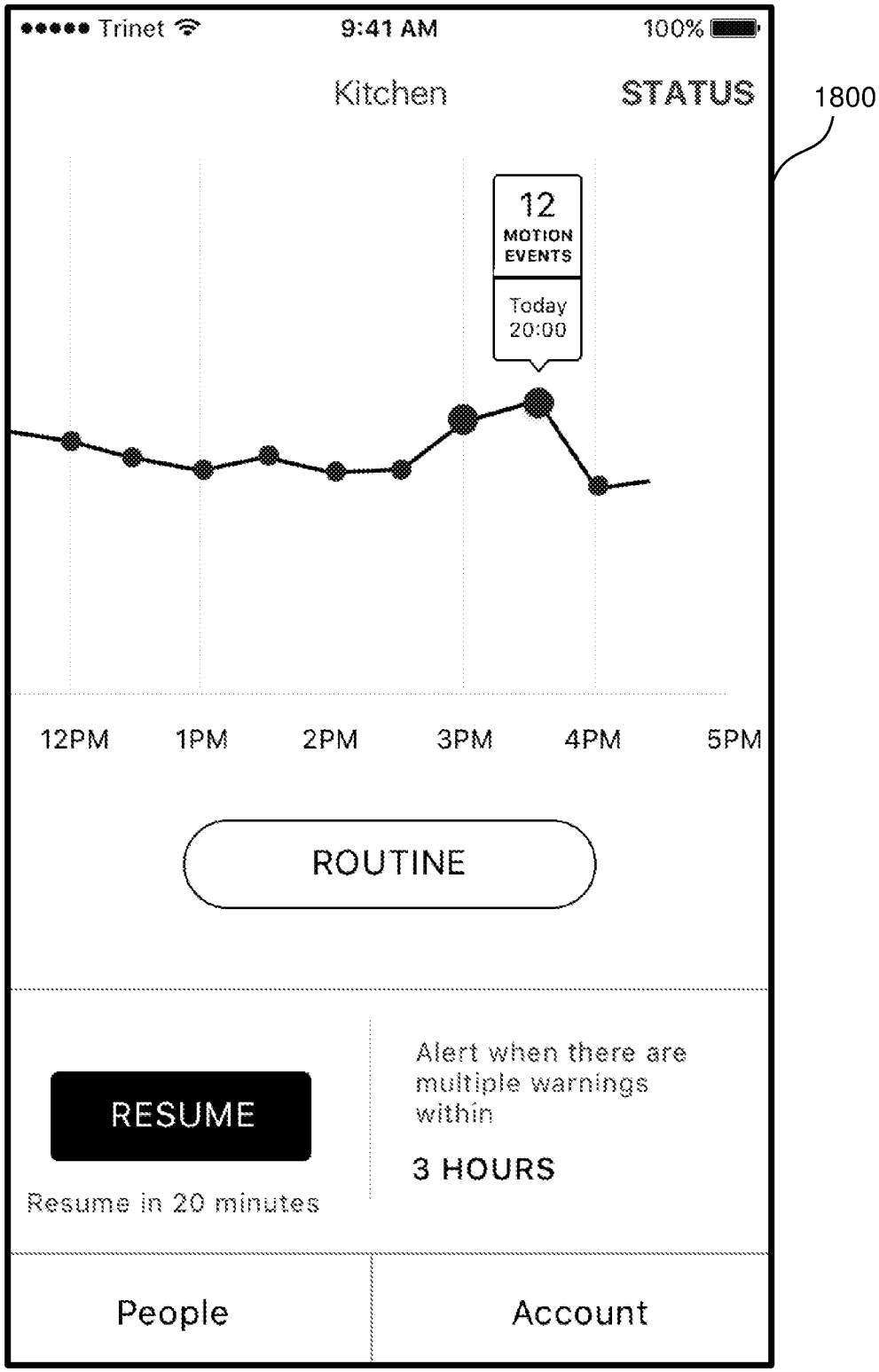

FIG. 18 is a screenshot 1800 showing a graph of events detected in the Kitchen over the time period ranging from 12 pm to 4:30 pm. In this example, the app reflects a current setting of the remote server 1550 by which the remote server 1550 will issue an alert if there are multiple warnings within a 3 hour time period. Depending on the configured schedule, a warning may correspond to a level of activity, such as unexpected activity during the middle of the night, or lack of activity, such as no activity in the Kitchen during a morning period from 7 am to 10 am, for example. No activity in the Kitchen during the prime morning period may be an indication that the user is ill and requires assistance.

Figure 19:
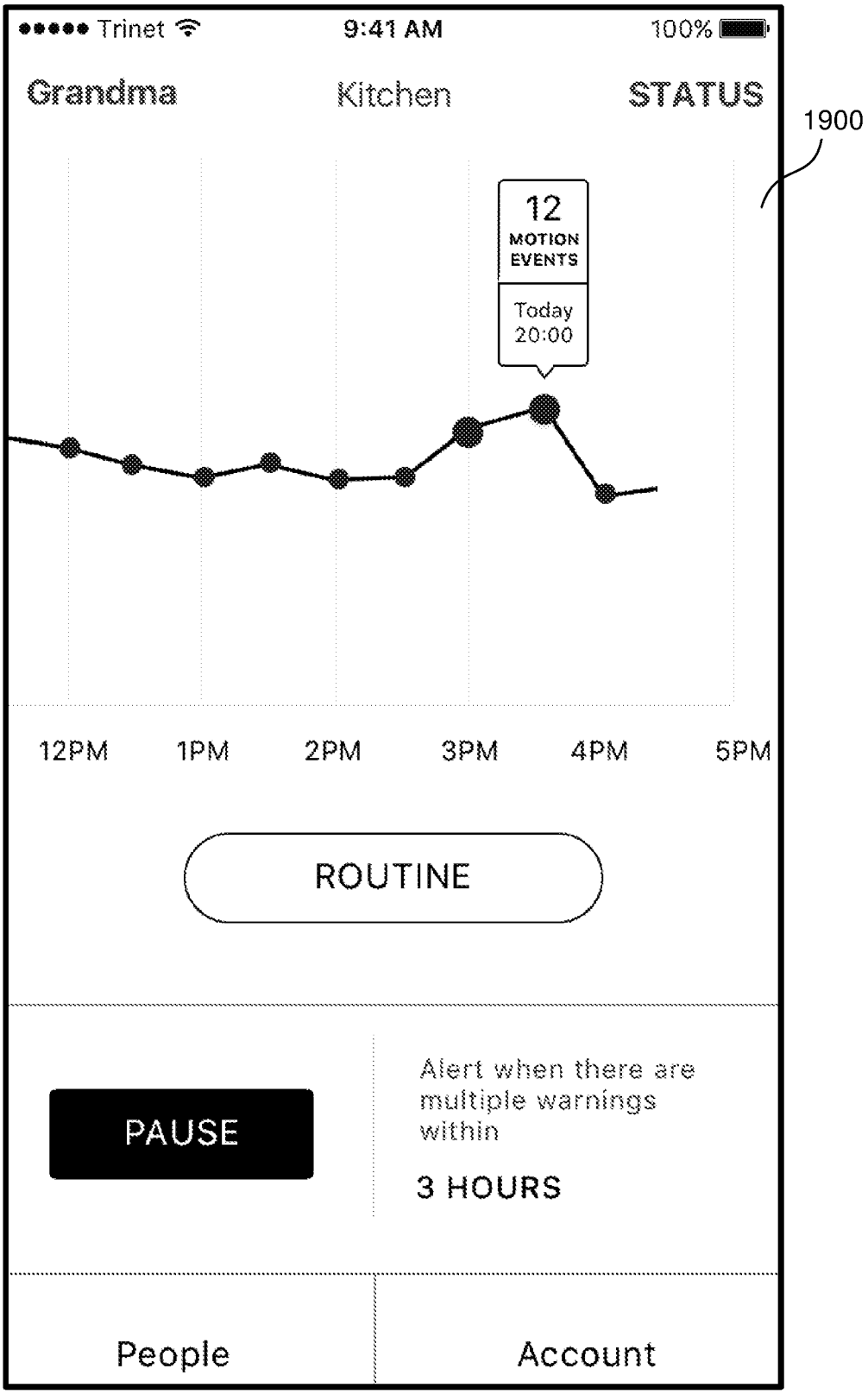

FIG. 19 is a screenshot 1900 showing a graph of events detected in the Kitchen over the time period ranging from 12 pm to 4:30 pm. In this example, the app includes a "Pause" button, which allows the user to stop the remote server from taking any action in relation to detected levels of activity or inactivity. For example, if a user is going out or away and thus their level of activity will deviate from the stored schedule of regular activity, the user can pause the monitoring associated with the monitoring devices 1510, 1515, 1520. The monitoring can be readily reactivated via the app or web browser on return of the user.

Figure 21:
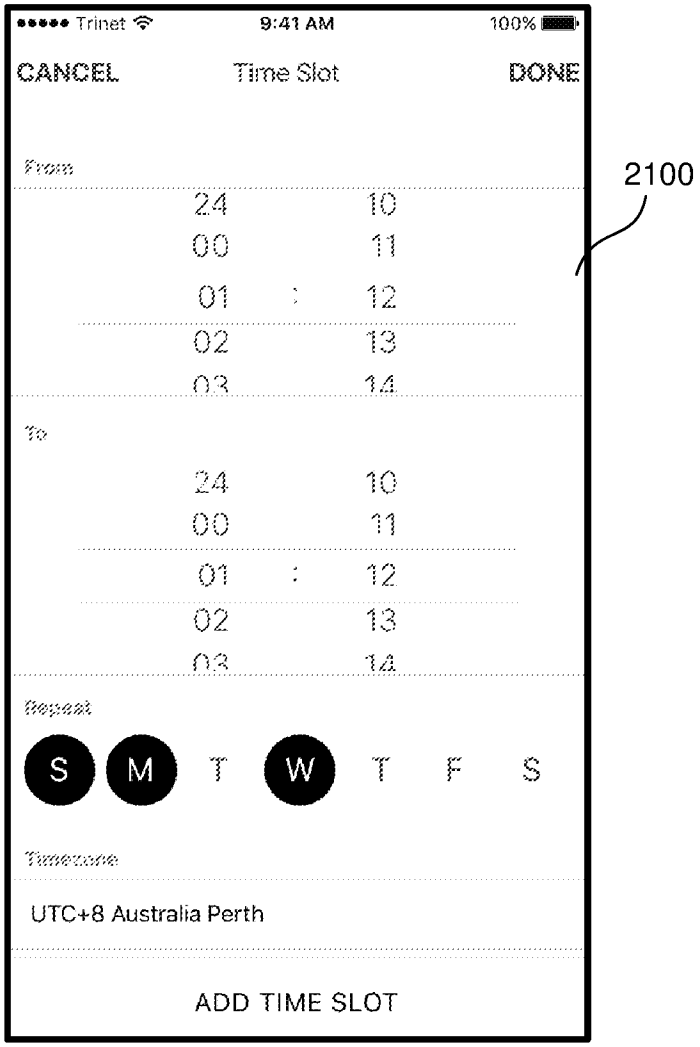
Figure 20:
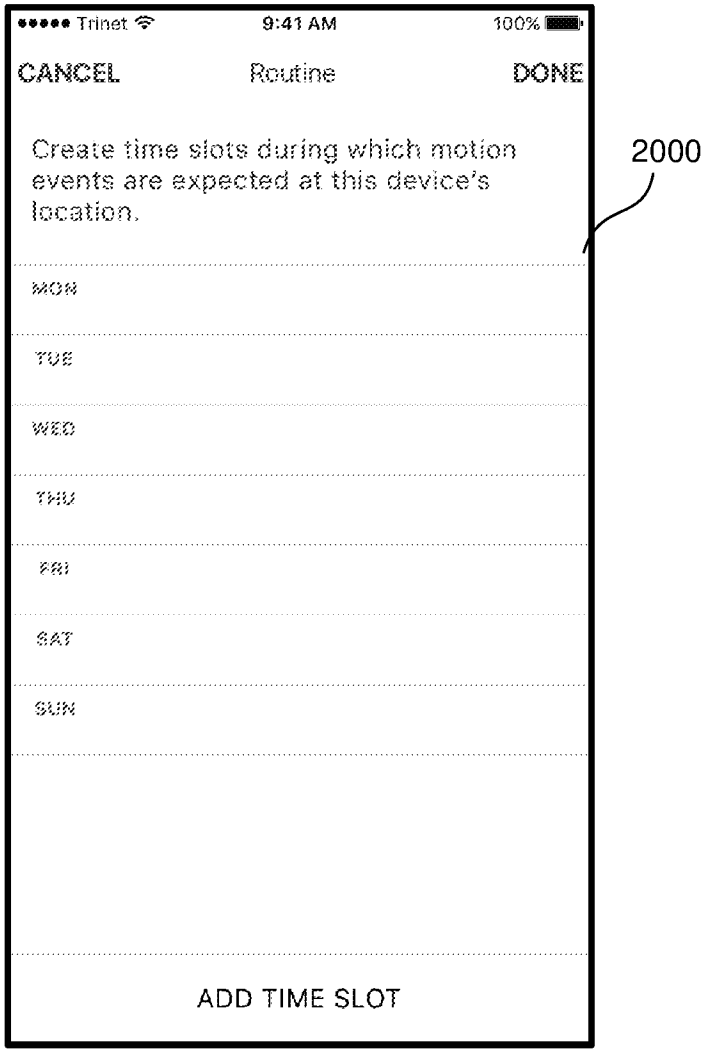
Figure 22:
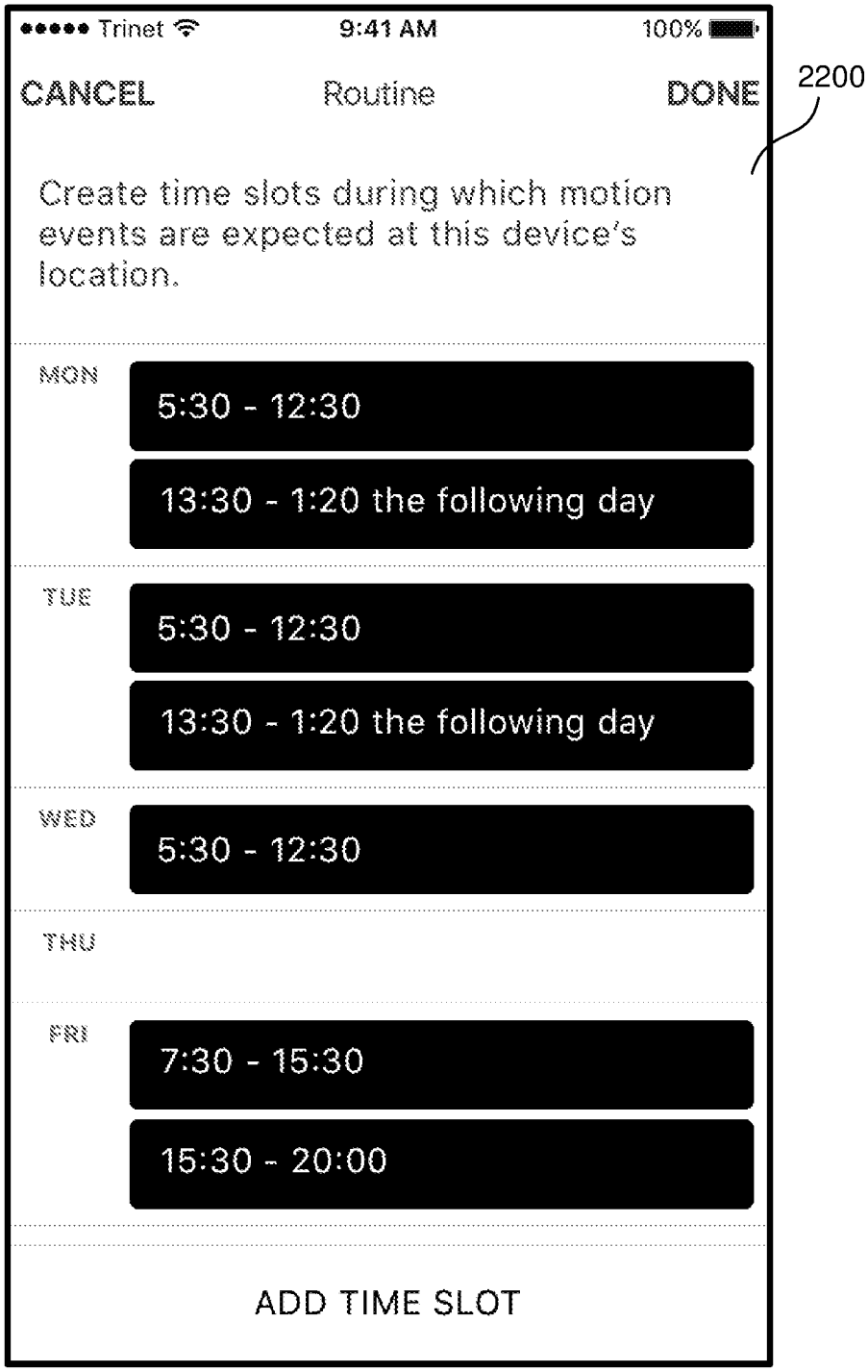

FIGS. 20 and 21 are screenshots 2000, 2100, respectively, that provide a user with an interface by which to configure a schedule or regular activity by creating time slots during which motion events are expected at the location in which the particular monitoring device 1510, 1515, 1520 is to be positioned. The user selects a day and then one or more time periods, defined by start and finish times, in order to configure the schedule. FIG. 22 is a screenshot 2200 illustrating a configured schedule, with time slots defined across the various days of the week. It will be appreciated that the schedule will vary from user to user and from each location at which the monitoring devices 1510, 1515, 1520 are positioned. Further, the schedule may need to be varied on a temporary or permanent basis at any time and the web browser and/or app allow the user with the ability to change and configure the schedule at will.

Figure 23:
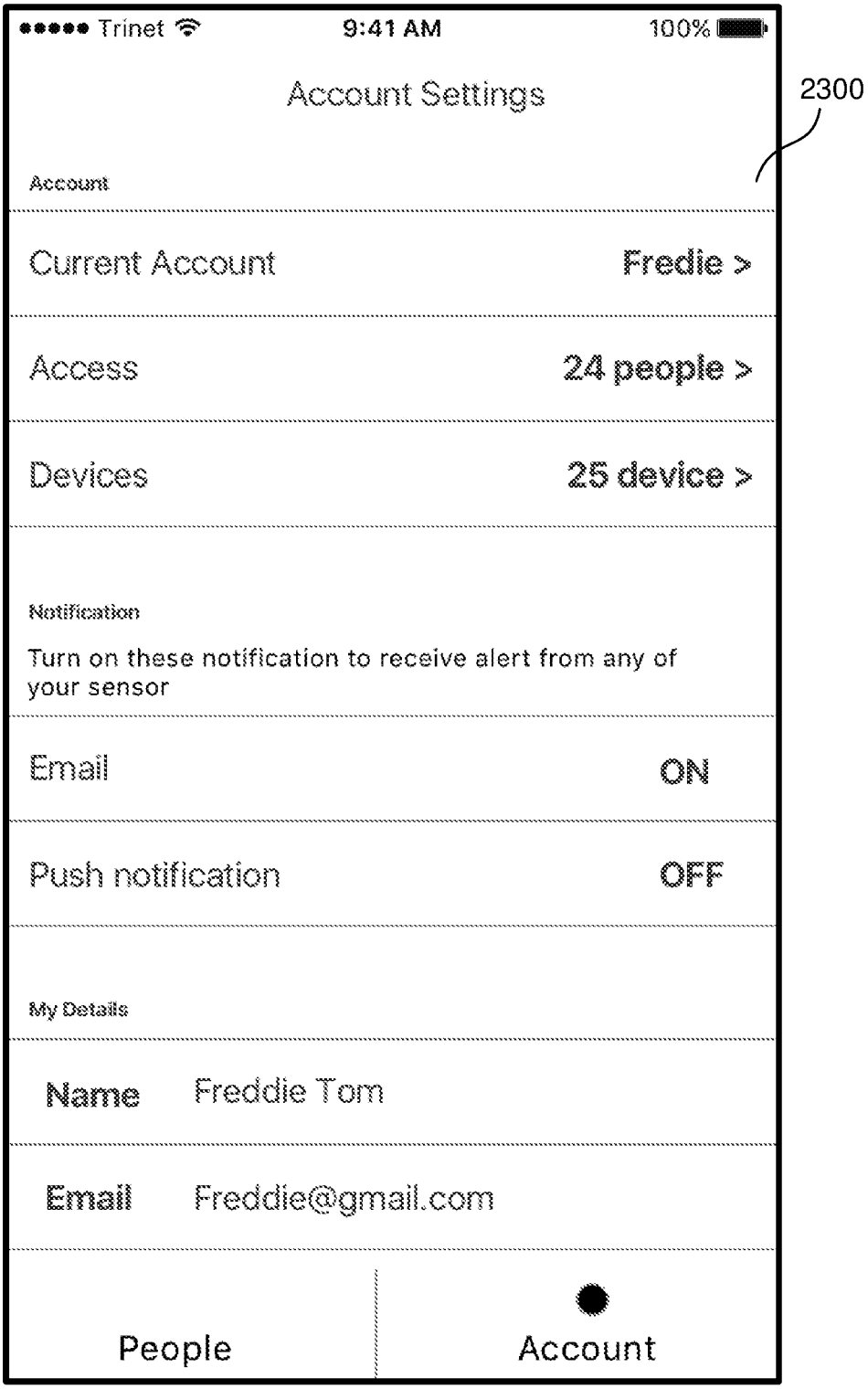

FIG. 23 is a screenshot 2300 allowing a user to configure account settings associated with the user's profile on the remote server 1550. In this example, the account settings include control of access, control of devices, settings relating to notifications, such as emails and push notifications, as well as user settings. Different settings may be presented, dependent on the particular implementation, user access level, and the like.

Figure 24:
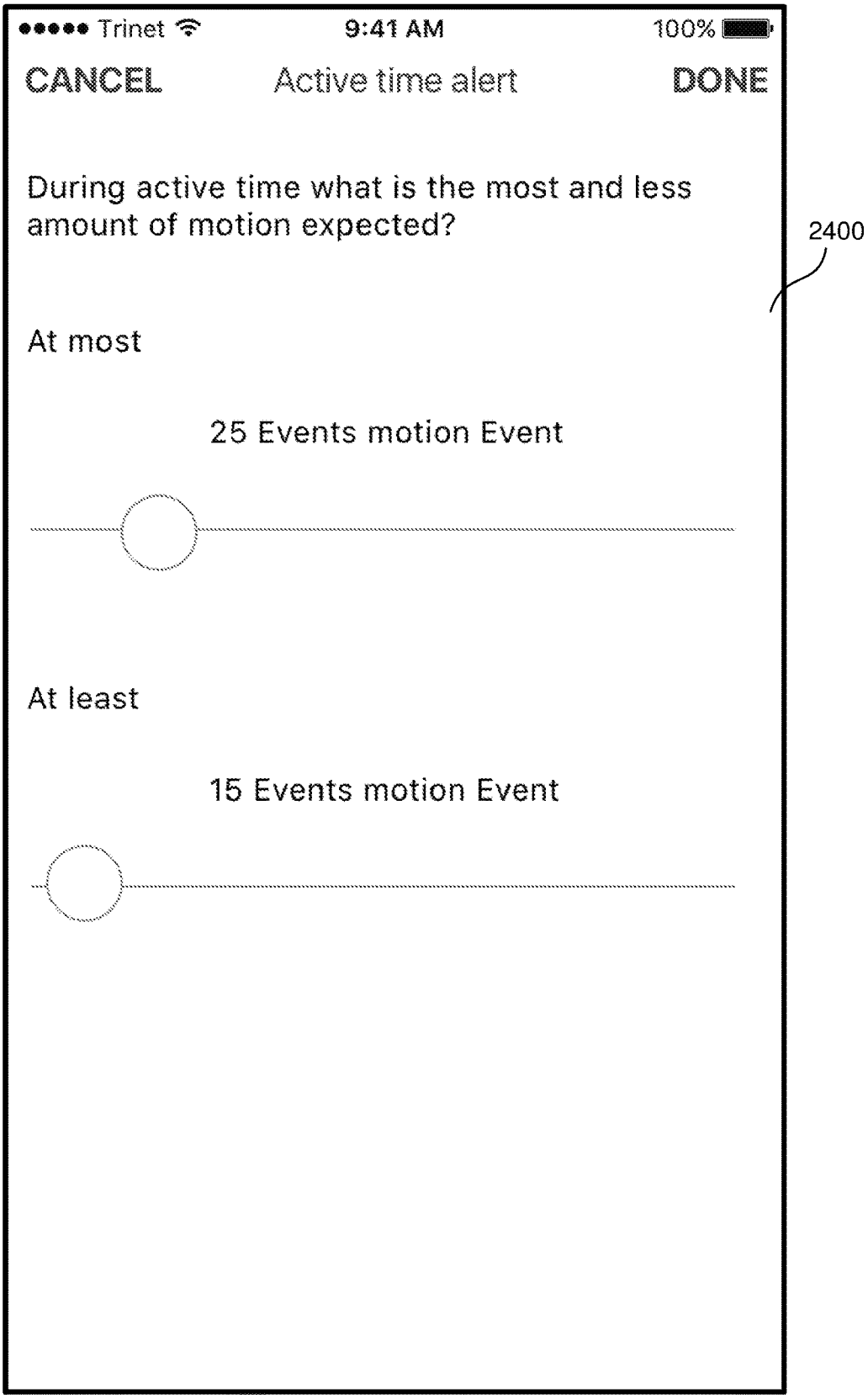

FIG. 24 is a screenshot 2400 showing an app interface by which a user is able to configure a sensitivity rating associated with a defined schedule. In this example, the user is able to set an upper and lower limit for the number of detected motion events. In this particular example, the user selects a range having at most 25 motion events and at least 15 motion events during an active time period. Consequently, an alert will be raised if fewer than 15 motion events or more than 25 motion events are detected during the active time period.

Figure 25:
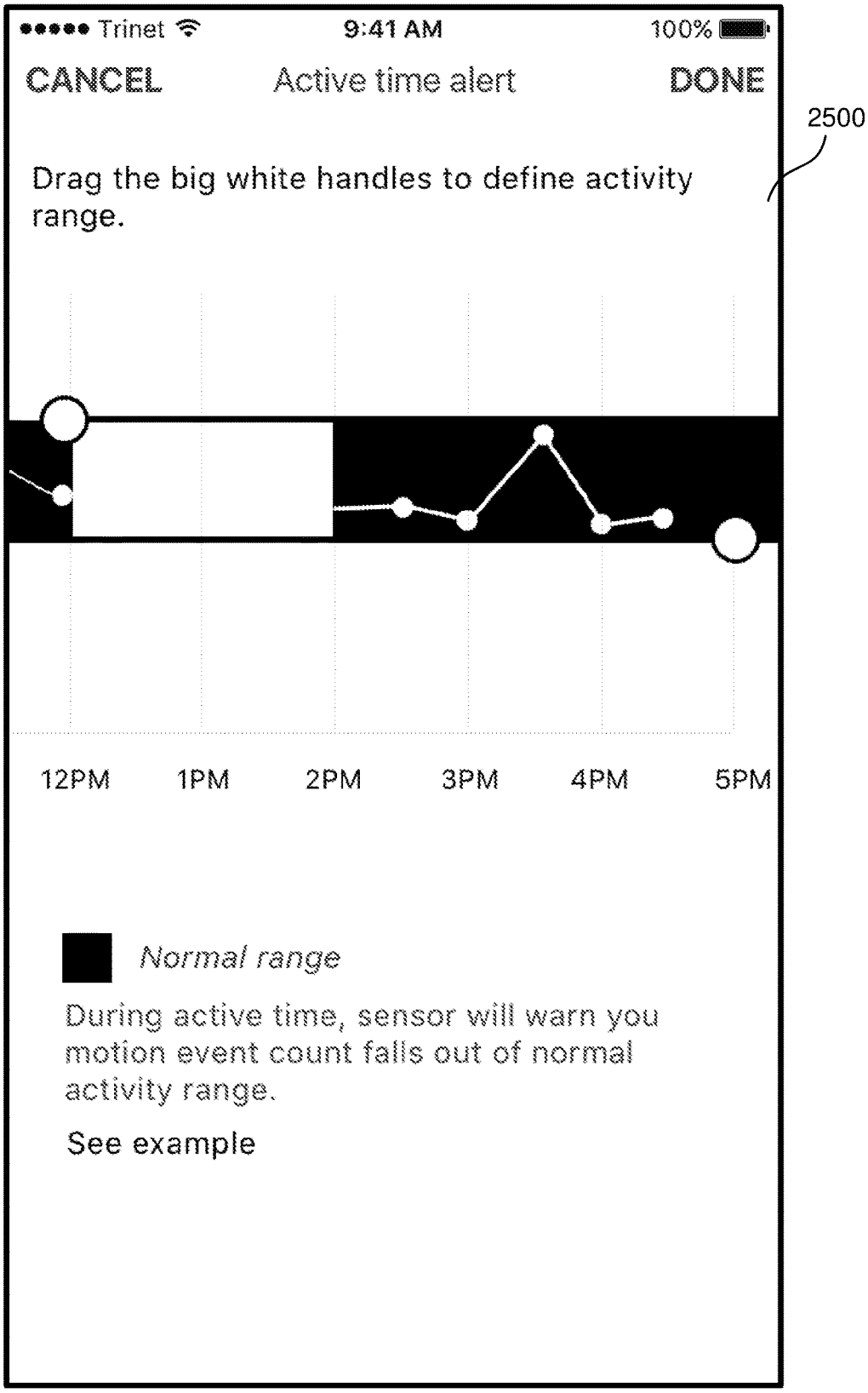
Figure 27:
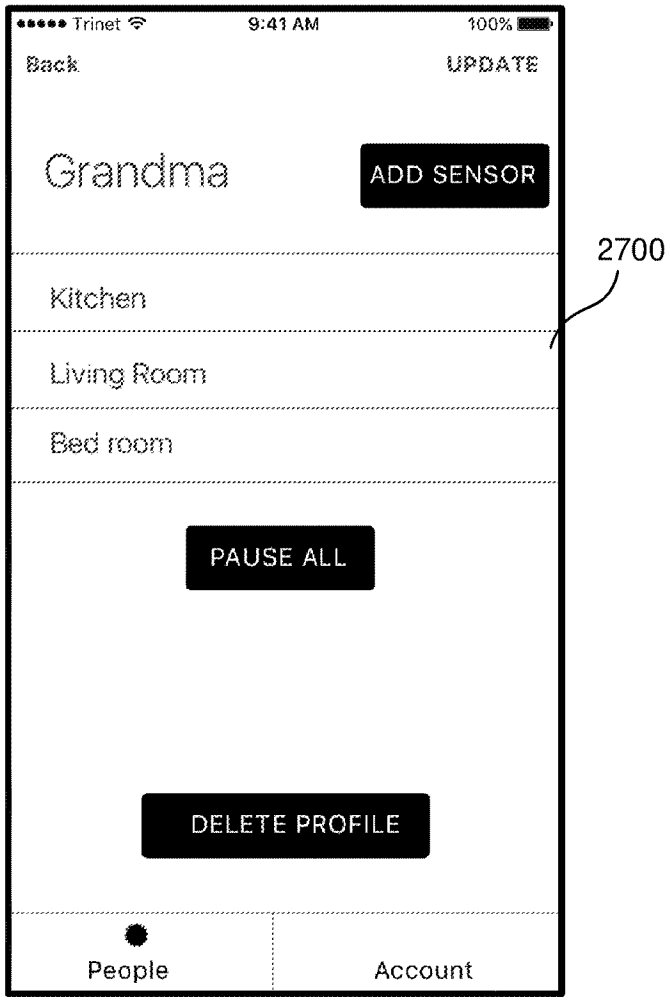
Figure 26:
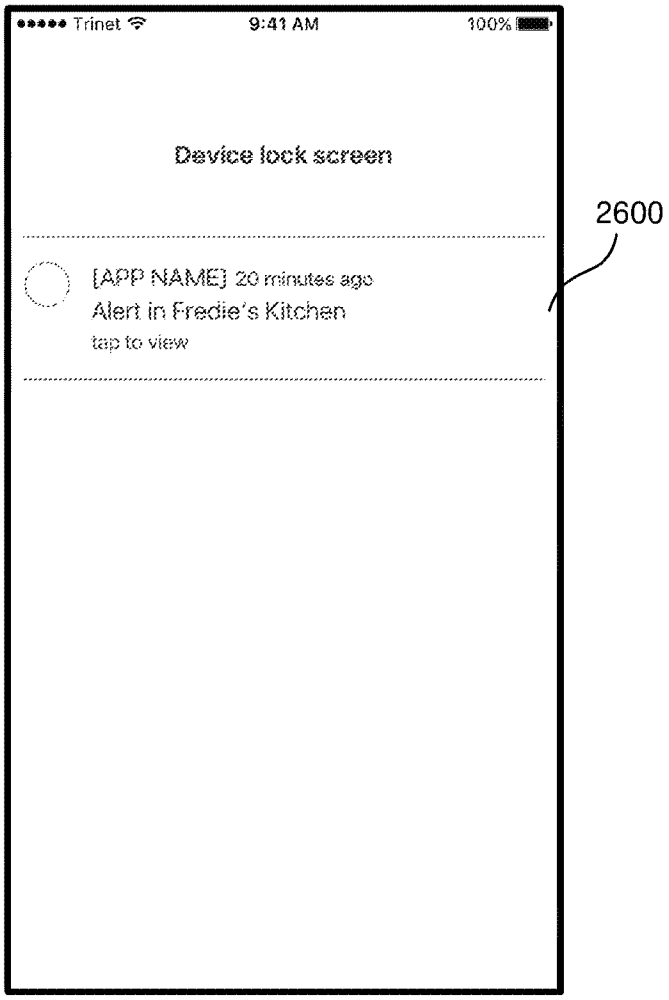
Figure 28:
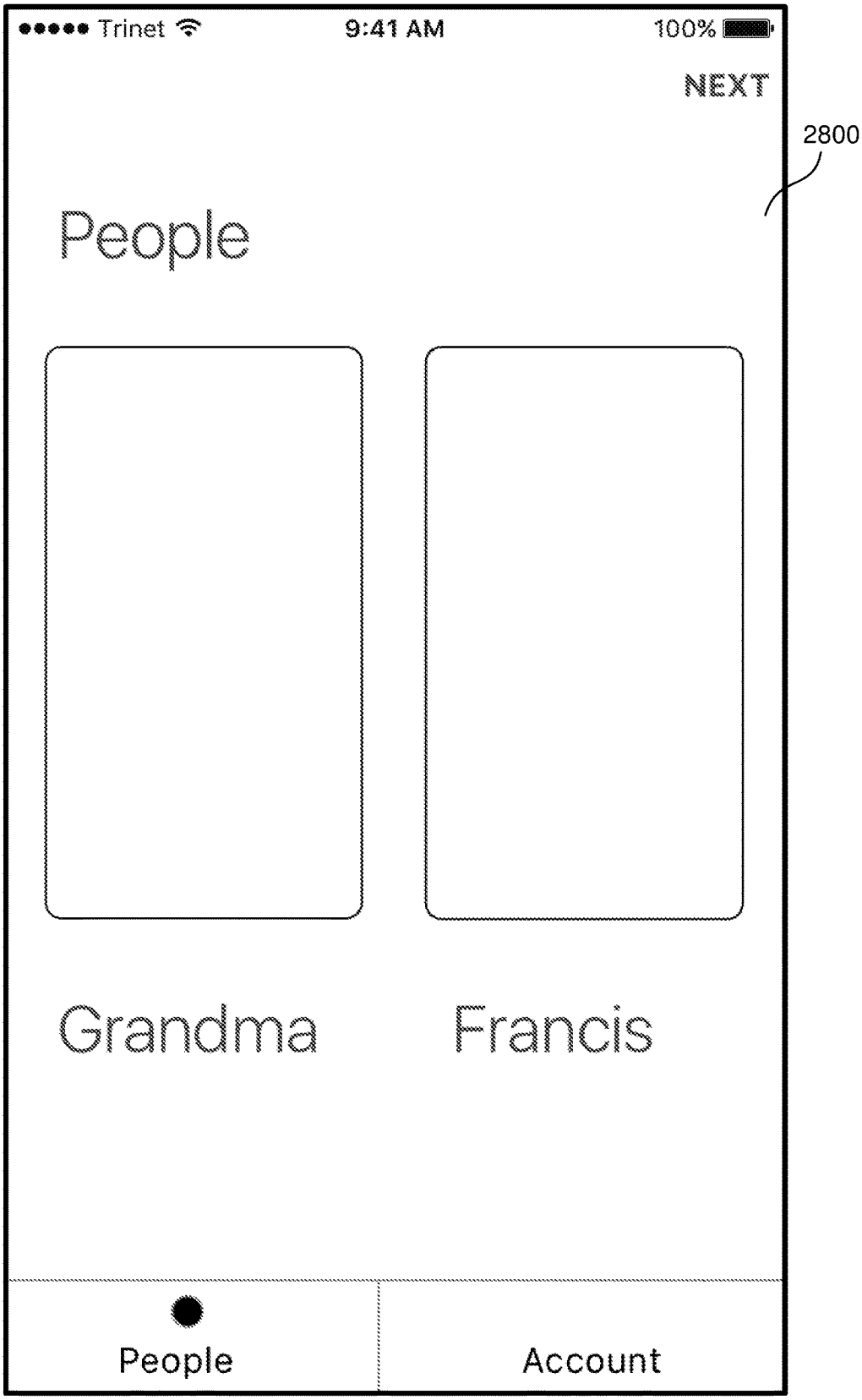

FIG. 25 is a screenshot 2500 illustrating a graphical user interface by which a user is able to drag handles to define an activity range. FIG. 26 is a screenshot 2600 illustrating an alert message in the form of a push notification presented on a device lock screen. In this example, the alert message informs the user of an alert in Freddie's Kitchen. FIG. 27 is a screenshot 2700 providing a user with an interface by which to add a sensor to one or more of the rooms: Kitchen, Living Room, Bedroom, and associated with the user Grandma. FIG. 28 is a screenshot 280 showing an interface by which a user is able to manage monitoring systems, such as the system 1500 of FIG. 15, in relation to one or more users, such as users Grandma and Francis, as shown in this example.

INDUSTRIAL APPLICABILITY

The arrangements described are applicable to the security and monitoring industries.

The foregoing describes only some embodiments of the present invention, and modifications and/or changes can be made thereto without departing from the scope and spirit of the invention, the embodiments being illustrative and not restrictive.

In the context of this specification, the word "comprising" and its associated grammatical constructions mean "including principally but not necessarily solely" or "having" or "including", and not "consisting only of". Variations of the word "comprising", such as "comprise" and "comprises" have correspondingly varied meanings.

As used throughout this specification, unless otherwise specified, the use of ordinal adjectives "first", "second", "third", "fourth", etc., to describe common or related objects, indicates that reference is being made to different instances of those common or related objects, and is not intended to imply that the objects so described must be provided or positioned in a given order or sequence, either temporally, spatially, in ranking, or in any other manner.

Although the invention has been described with reference to specific examples, it will be appreciated by those skilled in the art that the invention may be embodied in many other forms.

I claim:

1. A monitoring device comprising:

a protective housing containing:

a passive infrared (PIR) sensor;

a power supply a microcontroller;

a wireless transceiver; and a counter adapted to maintain a count of the number of times the PIR sensor has been activated;

wherein said power supply powers each of said PIR sensor, said microcontroller, said wireless transceiver, and said counter;

wherein the counter is adapted to communicate said count to the microcontroller for transmission; and wherein said microcontroller is adapted to send an alert message, via said wireless transceiver, upon receiving the count from the counter.

2. The monitoring device according to claim 1, wherein said wireless transceiver is adapted to implement a wireless transmission protocol selected from the group consisting of: 3G, 4G, Wi-Fi, Bluetooth, LTE, or Low-Power Wide-Area Network (LPWAN) technologies, such as LTE-MTC, LoRa, NarrowBand IoT, 6LowPAN, and Sigfox.

3. The monitoring device according to claim 1, further comprising:

a tamper switch adapted to detect tampering, wherein said microcontroller is adapted to send an alert message, via said wireless transceiver, upon receiving a tampering detection signal from said tamper switch.

4. The monitoring device according to claim 1, further comprising:

an accelerometer, wherein said microcontroller is adapted to send an alert message, via said wireless transceiver, upon receiving a movement detection signal from said accelerometer.

5. The monitoring device according to claim 1, further comprising at least one of a thermometer, GPS positioning unit, siren, light sensor, and microphone.

6. The monitoring device according to claim 5, wherein said monitoring device comprises a microphone and wherein said microcontroller is adapted to send an alert message, via said wireless transceiver, upon detecting an audio signal in excess of a predefined sound threshold.

7. The monitoring device according to claim 1, wherein the microcontroller is programmed to transmit, via said wireless transceiver, a heartbeat signal at predefined periodic intervals.

8. A system comprising:

a set of monitoring devices, each monitoring device including:

a protective housing containing:

a passive infrared (PIR) sensor;

a power supply a microcontroller;

a wireless transceiver; and a counter adapted to maintain a count of the number of times the PIR sensor has been activated;

wherein said power supply powers each of said PIR sensor, said microcontroller, said wireless transceiver, and said counter;

wherein the counter is adapted to communicate said count to the microcontroller for transmission; and wherein said microcontroller is adapted to send an alert message, via said wireless transceiver, upon receiving the count from the counter;

an administrative server coupled to a communications network; and a wireless base station for receiving said alert message, said wireless base station being coupled to a communications network and adapted to transmit said received alert message to said administrative server.

9. The system according to claim 8, wherein said wireless transceiver is adapted to implement a wireless transmission protocol selected from the group consisting of: 3G, 4G, Wi-Fi, Bluetooth, LTE, or Low-Power Wide-Area Network (LPWAN) technologies, such as LTE-MTC, LoRa, Narrow-Band IoT, 6LowPAN, and Sigfox.

10. The system according to claim 8, wherein each monitoring device transmits a heart beat signal to said administrative server, via said base station, at predefined periodic intervals.

11. The system according to claim 10, wherein said administrative server issues an alarm when a predefined time threshold expires without having received a heart beat signal from any one of said monitoring devices, said time threshold being greater than said predefined periodic interval.

12. The system according to claim 8, wherein said administrative server stores a schedule of regular activity associated with each of said monitoring devices, said schedule defining a range of expected activity for a set of periods throughout a day; and further wherein said administrative server issues an alarm when a detected level of activity detected by said set of monitoring devices deviates from said schedule by more than a predefined amount.

* * * * *